US006774866B2

(12) United States Patent
McKinzie, III et al.

(10) Patent No.: US 6,774,866 B2
(45) Date of Patent: Aug. 10, 2004

(54) MULTIBAND ARTIFICIAL MAGNETIC CONDUCTOR

(75) Inventors: William E. McKinzie, III, Fulton, MD (US); Shawn D. Rogers, Laurel, MD (US)

(73) Assignee: Etenna Corporation, Laurel, MD (US)

( * ) Notice: Subject to any disclaimer, the term of this patent is extended or adjusted under 35 U.S.C. 154(b) by 85 days.

(21) Appl. No.: 10/172,826

(22) Filed: Jun. 14, 2002

(65) Prior Publication Data

US 2003/0231142 A1 Dec. 18, 2003

(51) Int. Cl.[7] ..... H01Q 1/38

(52) U.S. Cl. ..... 343/909; 343/700 MS

(58) Field of Search ..... 343/700 MS, 756, 343/753, 909

(56) References Cited

U.S. PATENT DOCUMENTS 6,483,480 B1 * 11/2002 Sievenpiper et al. ..... 343/909
6,483,481 B1 11/2002 Sievenpiper et al. ..... 343/909

* cited by examiner

*Primary Examiner*—Michael C. Wimer
(74) *Attorney, Agent, or Firm*—Brinks Hofer Gilson & Lione

(57) ABSTRACT

A multi-band artificial magnetic conductor (AMC) is described in an electrically small antenna for use in hand-held wireless devices and base station antenna applications. The multi-band AMC contains a ground plane, two or more frequency selected surfaces (FSS) having periodic conductive patches disposed on opposing surfaces and a dielectric layer sandwiched between the surfaces, and dielectric layers between the FSS layers and between the lower FSS layer and the ground plane. Various parameters of the dual band AMC are chosen such that the AMC has non-harmonically related resonant frequencies within two or more different frequency bands.

62 Claims, 26 Drawing Sheets

Figure 2(a) A Cauer Type I LC Network
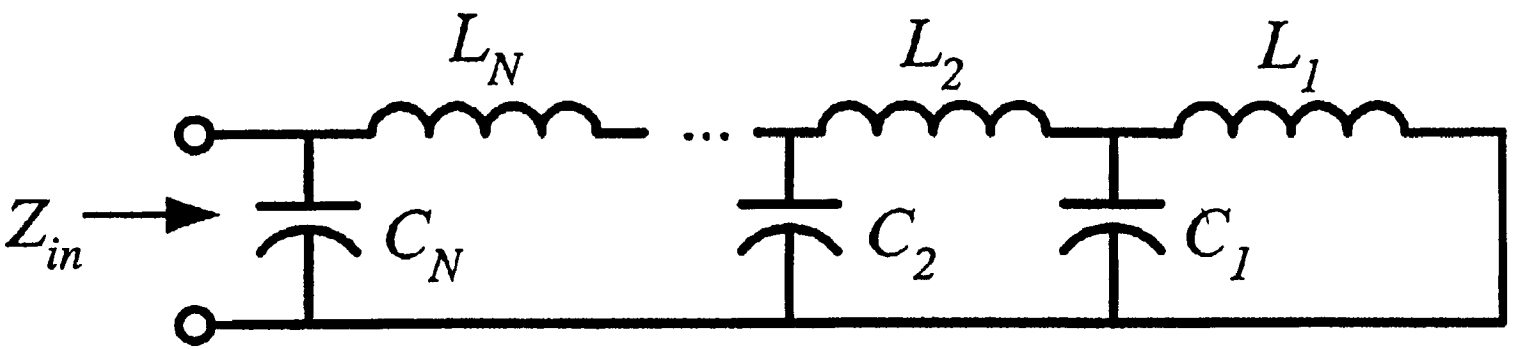

Figure 12: 850/1900 MHz Dual-Band AMC Panel
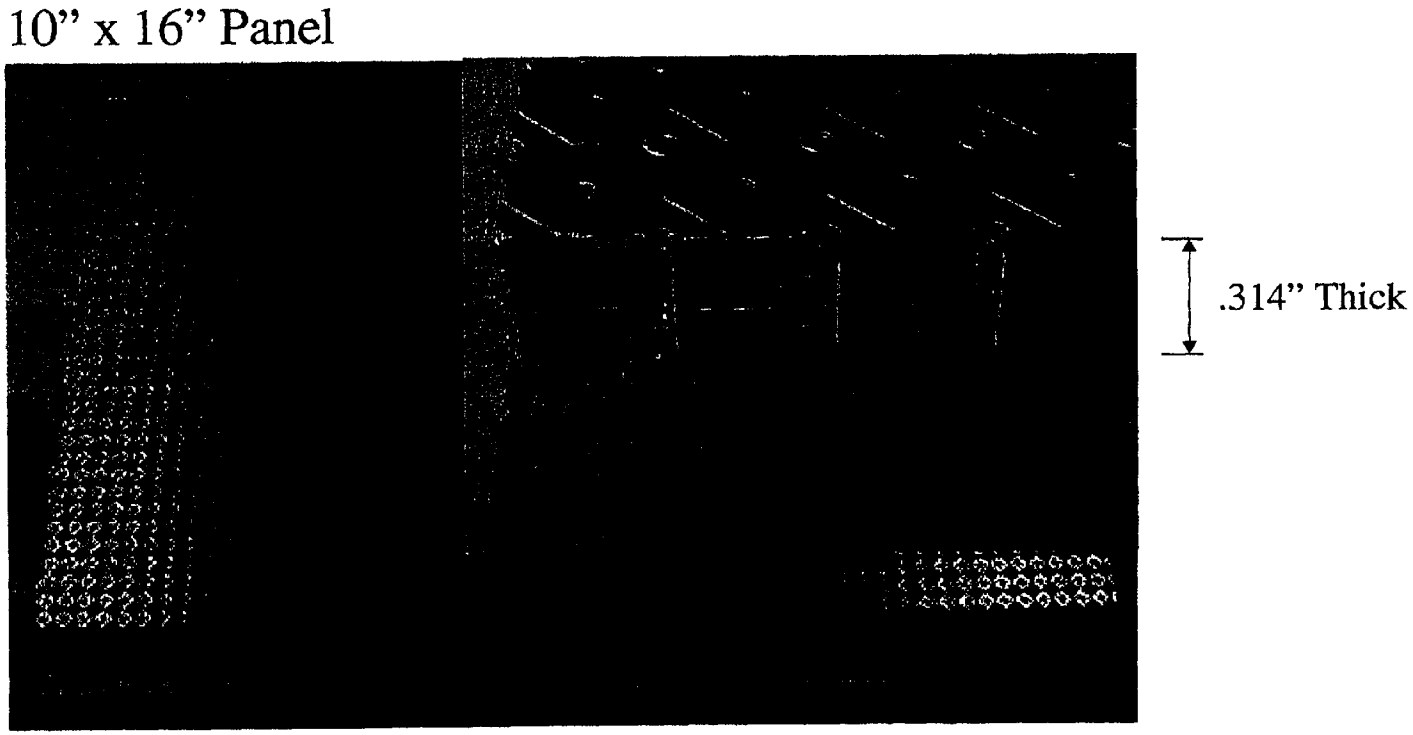

Figure 13. A triple band AMC
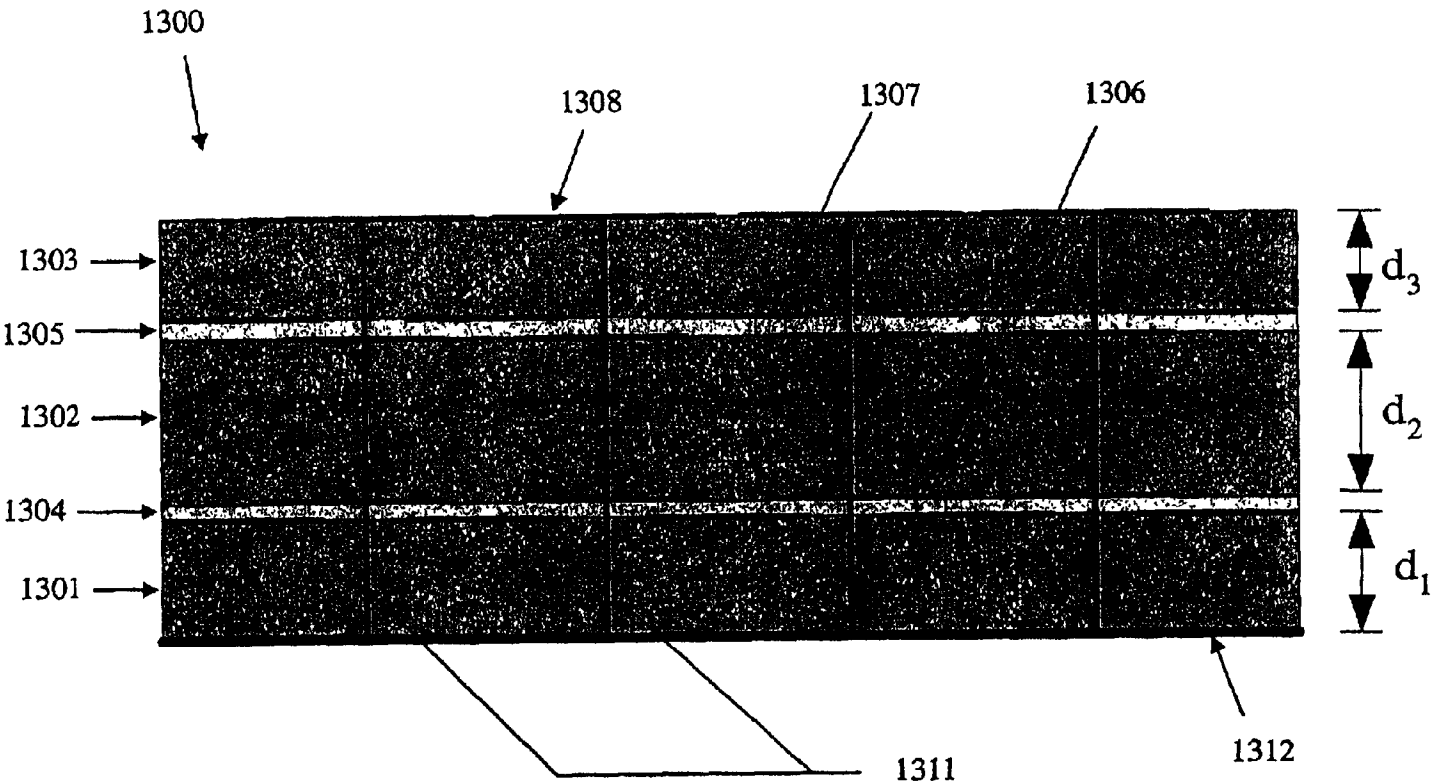

MULTIBAND ARTIFICIAL MAGNETIC CONDUCTOR

BACKGROUND

This invention relates to artificial magnetic conductors (AMCs) and devices incorporating AMCs. In particular, this invention relates to AMCs that are capable of operation at multiple separate frequency bands.

Due to the constant demand for improved efficiency of antennas and increased battery lifetime in portable communication systems, high-impedance surfaces have been the subject of increasing research. High-impedance surfaces have a number of properties that make them important for applications in communication equipment. The high-impedance surface is a lossless, reactive surface, whose equivalent surface impedance, $$Z_s = \frac{E_{tan}}{H_{tan}}$$

(where $E_{tan}$ is the tangential electric field and $H_{tan}$ is tangential magnetic field), approximates an open circuit. The surface impedance inhibits the flow of equivalent tangential electric surface current and thereby approximates a zero tangential magnetic field, $H_{tan} \approx 0$.

One of the main reasons that high-impedance surfaces are useful is because they offer boundary conditions that permit wire antennas (electric currents) to be well matched and to radiate efficiently when the wires are placed in very close proximity to this surface. Typically, antennas are disposed less than $\lambda/100$ from the high-impedance surfaces (usually more like $\lambda/200$), where $\lambda$ is the wavelength of operation. The radiation pattern from the antenna on a high-impedance surface is substantially confined to the upper half space, and the performance is unaffected even if the high-impedance surface is placed on top of another metal surface. The promise of an electrically-thin, efficient antenna is very appealing for countless wireless device and skin-embedded antenna applications.

One embodiment of a conventional frequency selective surface (FSS) 102 and AMC 100 is shown in FIG. 1. It is a printed circuit structure, using an electrically-thin, planar, periodic structure, with vertical conductors (vias) 104 forming a rodded medium, and horizontal capacitive patches 106, which can be fabricated using low cost printed circuit technologies. The combination of the FSS 102, connected to a ground plane 110 through a rodded medium is known as an artificial magnetic conductor (AMC). The rodded medium is periodic structure of parallel vertical conductors, or vias 104, embedded in a host dielectric medium that we denote as the spacer layer 108. Near its resonant frequency, the AMC approximates an open circuit to a normally incident plane wave, and it suppresses TE and TM surface waves over the band of frequencies near where it operates as a high-impedance surface.

An antenna, such as a bent-wire monopole, may be disposed within close proximity to the surface of the AMC, thus decreasing the overall thickness of the device. Bent-wire monopoles are primarily used as the antenna element that is integrated with an AMC. The bent-wire monopole is simply a thin wire or printed strip located a small fraction of a wavelength about $\lambda/200$ above the AMC surface. The bent-wire monopole is disposed on the AMC surface using a thin layer of low loss dielectric material. Typically, a coaxial connector feeds one end of this strip antenna. The outer conductor of the coaxial connector is soldered to the conducting ground plane 110 of the AMC, and the inner conductor extends vertically through the AMC and a thin dielectric layer upon which the monopole is printed or disposed, to connect to the monopole.

Present communication applications, such as cellular telephones, may transmit and receive signals at several different frequency bands. The most popular of these frequency bands in North America are the GSM band (824–894 MHz) and the PCS band (1850–1990 MHz). In Europe, the GSM band covers 876–960 MHz, and the DCS band (1710–1880 MHz) is used. Conventional AMCs have only a single frequency band over which they exhibit high-impedance characteristics and surface waves are suppressed. Thus, applications requiring an antenna flush-mounted against a conventional AMC are limited to operation within the single frequency band. Multiple conventional AMCs/antenna combinations are needed to adequately operate within multiple frequency bands, thereby increasing the size and manufacturing cost of multi-frequency devices.

BRIEF SUMMARY

One object of the present invention is to provide a single, electrically-thin AMC that exhibits high-impedance characteristics and adequately suppresses surface waves in multiple frequency bands. Another object of the present invention is to decrease the size and cost of devices that incorporate AMCs and which operate in multiple non-harmonically related frequency bands.

In a first embodiment, a dual band AMC is modeled by an equivalent circuit having at least two shunt capacitors, which represent sheet capacitances of frequency selective surfaces of the AMC and at least two series inductive elements. The capacitors and inductive elements form an equivalent circuit which is a Cauer type I LC ladder network. The equivalent circuit has two non-harmonically related resonant frequencies.

The inductive elements may be electrically-short transmission lines or inductors. The resonant frequency bands may cover GSM and PCS, GSM and DCS, or GPS L1 and L2 bands, or other bands as dictated by the application.

Another embodiment is a method of establishing parameters (physical and/or frequency) of an AMC in at least desired two frequency bands. The AMC comprises at least two frequency selective surfaces, each having at least one layer of periodic conductive patches. The method comprises: choosing desired two frequency bands, choosing sheet capacitances for each FSS, selecting values for: gap widths between conductive patches of a first of the frequency selective surfaces, permittivities of dielectric layers between the layers that contain the conductive patches, thicknesses of the dielectric layers, and a chamfer distance for conductive patches of a second of the frequency selective surfaces. The method also comprises determining an overlap area of conductive patches on each FSS, determining a periodicity of the conductive patches on each FSS, and determining a chamfer distance for conductive patches of each FSS for which the chamfer distance was not selected.

An alternative embodiment of such a method comprises: grounding a first conductive layer, separating the frequency selective surfaces, separating the first conductive layer from one of the frequency selective surfaces, and connecting the periodic conductive patches on a first layer of the at least one layer of periodic conductive patches of a first frequency selective surface of the at least two frequency selective surfaces to the first conductive layer and connecting at least some of the periodic conductive patches on a first layer of the at least one layer of periodic conductive patches of a second frequency selective surface of the at least two frequency selective surfaces to the first conductive layer.

Another embodiment of a dual band AMC comprises a ground plane, a first FSS separated from the ground plane by a first dielectric layer and having a first layer and a second layer of overlapping periodic conductive patches separated by a second dielectric layer. The first layer of conductive patches is more proximate to the ground plane than the second layer of conductive patches. The AMC also comprises a second FSS separated from the first FSS by a third dielectric layer. The second FSS has a third layer of periodic conductive patches and is more distal to the ground plane than the first FSS.

The second FSS may further comprise a fourth layer of periodic conductive patches overlapping the third layer of conductive patches and separated from the third layer of conductive patches by a fourth dielectric layer. The fourth layer of conductive patches is more distal to the ground plane than the third layer of conductive patches.

Another FSS may further comprise a fifth layer of periodic conductive patches separated from the fourth layer of conductive patches by a fifth dielectric layer. The fifth layer of conductive patches is more distal to the ground plane than the fourth layer of conductive patches. The number of FSSs and layers of conductive patches on the FSS depends on the desired number and placement of non-harmonically related resonant frequencies.

Another embodiment of a dual band AMC comprises a ground plane, a plurality of FSS layers, each FSS layers having periodic conductive patches, a first dielectric layer separating each of the FSS layers, and a second dielectric layer separating the ground plane from one of the FSS layers.

In a yet another embodiment, a triple band AMC is modeled by an equivalent circuit having at least three shunt capacitors, which represent sheet capacitances of frequency selective surfaces of the AMC and at least three series inductive elements. Again, the capacitors and inductors form an equivalent circuit which is a Cauer type I network.

DESCRIPTION OF DRAWINGS

FIG. 2(*b*) depicts an equivalent circuit model of an embodiment of the present dual band AMC;

FIG. 2(*c*) depicts an equivalent circuit model of an embodiment of the present triple band AMC;

FIG. 3(*b*) is a graph of the phase of the reflection coefficient for an embodiment of the circuit model of FIG. 2(*c*);

FIG. 4(*b*) depicts another equivalent circuit model of an embodiment of the triple band AMC;

FIG. 12 shows top views of one embodiment of the dual band AMC; and

FIG. 13 illustrates a section view of a triple band AMC.

DETAILED DESCRIPTION OF PREFERRED EMBODIMENTS

The design of multi-layered artificial magnetic conductors (AMCs) that resonate in different non-harmonically related frequencies is discussed herein. AMCs are electrically-thin, relatively inexpensive, and easy to fabricate using conventional printed circuit board processes. Devices that use these AMCs may thus be relatively inexpensive to manufacture while retaining superior frequency response characteristics compared to those of conventional single-frequency response AMCs.

Multi-band AMCs are generally used in cooperation with antennas flush-mounted on the surface of the AMC. A flush-mounted antenna is often mounted in close proximity to the surface of the AMC, as above, typically $\lambda/100$-$\lambda/200$ from the AMC surfaces, where $\lambda$ is the minimum wavelength of operation of the antenna. Thus, devices that use multi-band AMC/antenna combinations are able receive and transmit electromagnetic signals at different frequencies in multiple frequency bands, while still enjoying the high-impedance and surface wave suppression properties of the AMC at these frequencies and maintaining substantially the same advantages of decreased thickness, weight and cost inherent in a single band AMC. This greatly benefits portable electronic devices in which RF communication in these bands is important, such as mobile phones or cordless (home) telephones.

At present, the most common frequencies bands used in consumer electronic communication in North America are the GSM band (824–894 MHz) and the PCS band (1850–1990 MHz). In Europe the GSM band (876–960 MHz) and the DCS band (1710–1880 MHz) are prevalent. Obviously, other frequency bands may also be of interest, such as the GPS L1 and L2 bands (centered at 1575 and 1227 MHz, respectively), and thus the multi-band AMCs may be designed for operation within those frequency bands instead.

Figure 1:
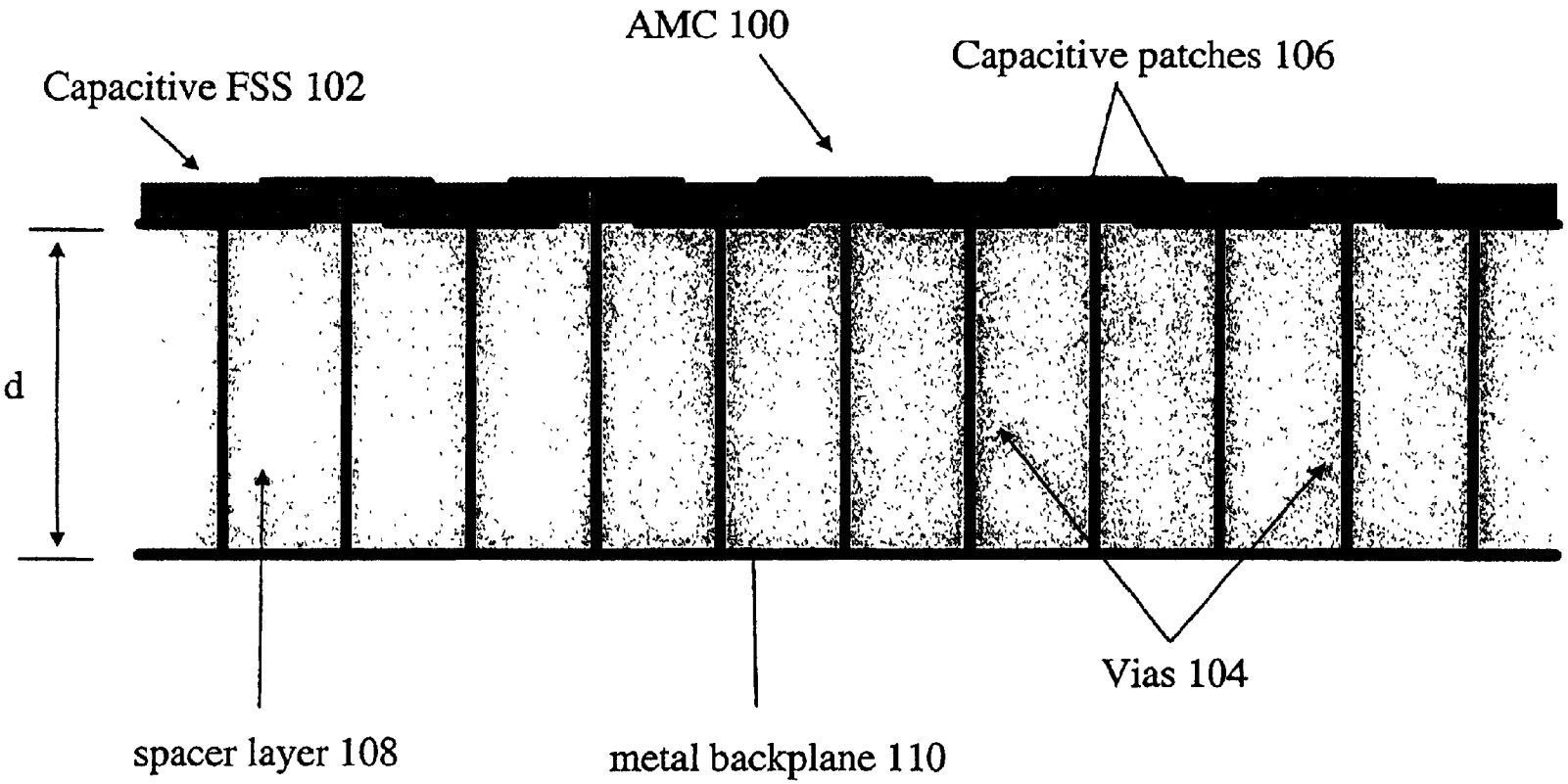
Figure 1 Prior Art
FIG. 1 illustrates a conventional AMC.
Figure 2B:
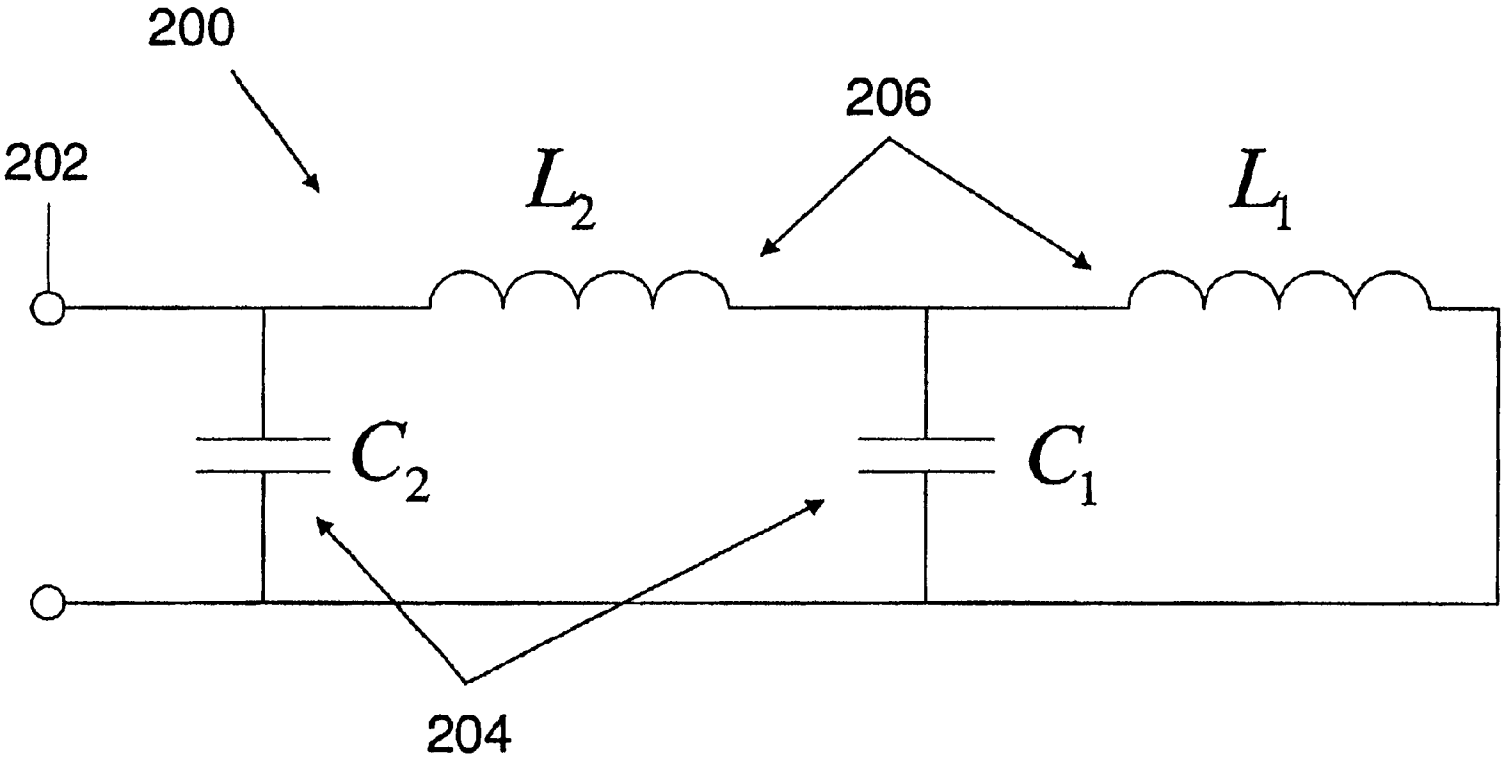
FIG. 2(*a*) depicts an equivalent circuit for a Cauer type I network of order N.
Figure 2C:
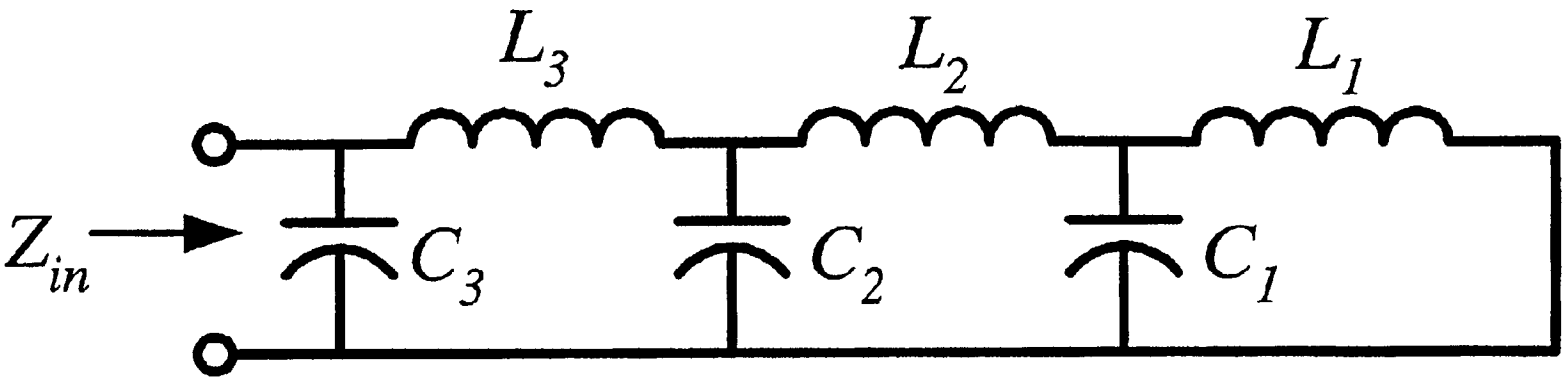

A fundamental electrical model of a multi-layer AMC can be understood in the context of FIG. 2(*a*). This electrical network is a classic Cauer Type I network, as shown in conventional textbooks such as Aram Budak, *Passive and Active Network Analysis and Synthesis*, Houghton Mifflin Company, Boston, 1974, pp. 93–94. A Cauer type I network is a special type of LC ladder network in which all capacitors are simple shunt elements, and all inductors are simple series elements. In some cases, a Cauer type I network is a two-port network with the second port on the right side of $L_1$. Here $L_1$ and $C_1$ are shorted together to create a one-port reactive circuit.

FIG. 2(*a*) introduces both single and multi-band AMC structures using an N-pole LC network as a model for the TEM waves which reflect off the AMC at normal incidence.

The FSS layers of the AMCs are simple capacitive FSS structures. This means that the TEM mode equivalent circuit for each FSS is a simple shunt capacitor, at least to first order. The size of the capacitive patches in the FSS layers are small with respect to a wavelength, typically less than $\lambda_o/10$ where $\lambda_o$ is a free space wavelength at the AMC resonant frequency. The series inductors of FIG. 2(*a*) model electrically short transmission lines for the dielectric spacer layers found between the capacitive FSS and the ground plane, or between FSS layers.

In his 1999 UCLA dissertation, Sievenpiper discusses single band AMCs. This is the case where N=1 for the Cauer type I LC network of FIG. 2(*a*). Only $L_1$ and $C_1$ are needed to model the reflection phase of Sievenpiper AMCs, because only one frequency exists where a zero degree reflection phase is found: $\omega=1/\sqrt{L_1C_1}$.

The present embodiments are multi-band AMCs that are designed by setting N=2 for a dual-band response, N=3 for triple band response, etc. Hence, there will be N resonant frequencies where the reflection phase will be zero degrees for an Nth order network. The input impedance for the Nth order, one-port, Cauer type I network is given by the continued fraction expansion:

$$Z_{in} = \cfrac{1}{sC_N + \cfrac{1}{sL_N + \cfrac{1}{sC_{(N-1)} + \cfrac{1}{sL_{(N-1)} + \ldots}}}}$$

For practical cases of N=2 and N=3, we can reduce this continued fraction to a rational function (a ratio of polynomials). The roots of the denominator of this rational function identify the AMC resonant frequencies.

One advantage of modeling multi-layer AMCs using equivalent networks is that existing linear circuit simulators can be used to rapidly synthesize the circuit values of multi-layer, multi-band AMCs.

An initial step in determining the configuration of a dual band AMC and components is thus determining the frequency range of operation. In this regard, a one-port equivalent circuit model 200 that represents the dual band AMC, such as that shown in FIG. 2(*b*), may be used to aid in designing the AMC. This TEM mode equivalent circuit for plane waves at normal incidence contains an input port 202, a pair of capacitors 204 and a pair of inductive elements 206 (in this case, inductors). In this model, an electromagnetic signal is introduced into the input port 202. The capacitors 204 and inductors 206 are arranged in a Cauer Type I ladder network as shunt $C_2$, series $L_2$, shunt $C_1$, and series $L_1$. The end of $L_1$ is connected to ground as shown in FIG. 2(*b*).

Figure 3A:
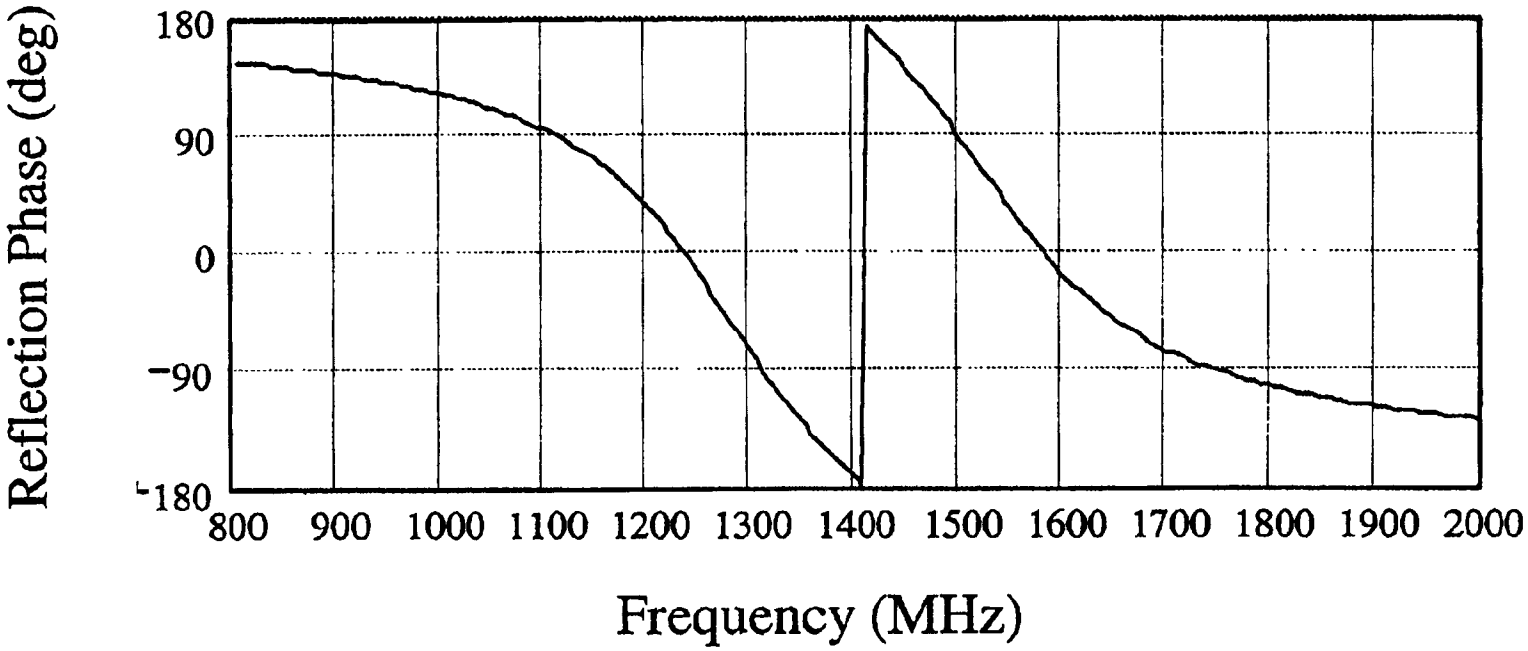
FIG. 3(*a*) is a graph of the phase of the reflection coefficient for an embodiment of the circuit model of FIG. 2(*b*)
Figure 3B:
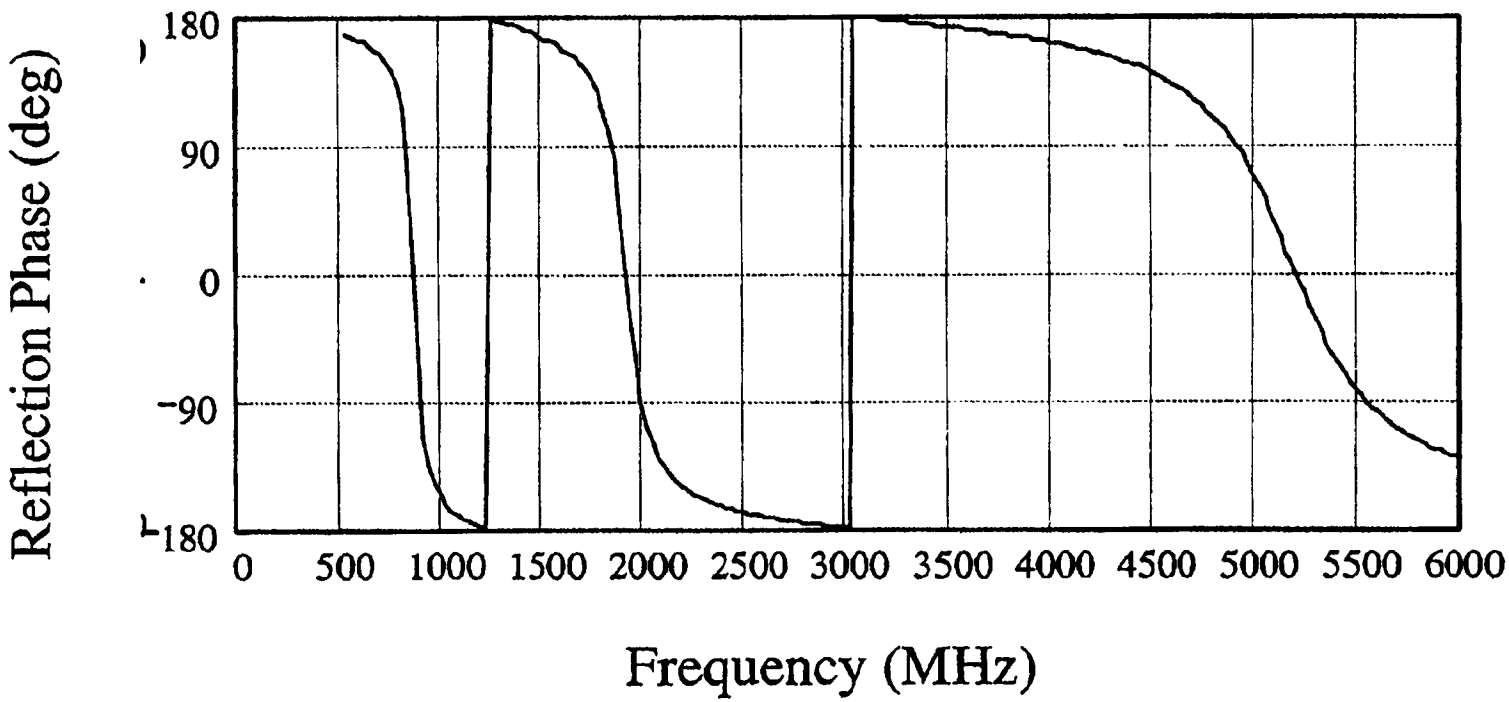

At the resonant frequency, the input reactance of this one-port circuit 200 becomes very large and the phase of the reflection coefficient is zero. The high-impedance band is defined by the frequencies over which the phase of the reflection coefficient is between ±90 degrees. The input impedance of this circuit 200 is given by:

$$Z_{in}(s) = \frac{s(L_1 + L_2 + s^2L_1L_2C_1)}{s^4L_1C_1L_2C_2 + s^2(L_1C_1 + L_1C_2 + L_2C_2) + 1}.$$

where s=jω. Solving for the roots of the denominator of the input impedance yields the two AMC resonant frequencies of the circuit 200. The presence of the $L_1C_2$ term in the denominator of the input impedance indicates that the two resonant frequencies actually cannot be adjusted independently of each other simply by defining the products $L_1C_1$ and $L_2C_2$. FIG. 3(*a*) shows a graph of one example of the phase of the reflection coefficient for a circuit model with parameters chosen for the GPS L1 and L2 bands.

Figure 4A:
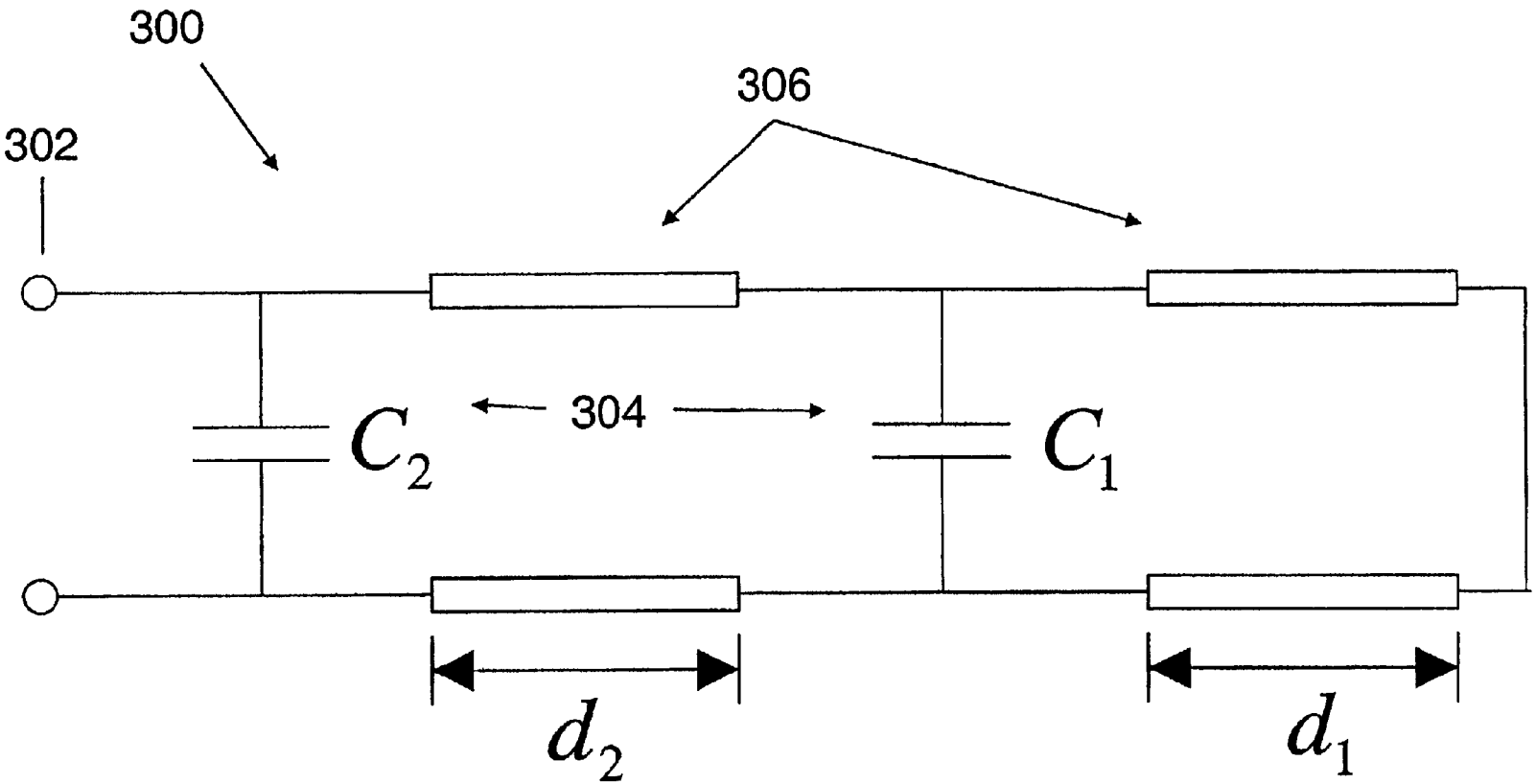
FIG. 4(*a*) depicts another equivalent circuit model of an embodiment of the dual band AMC.
Figure 4B:
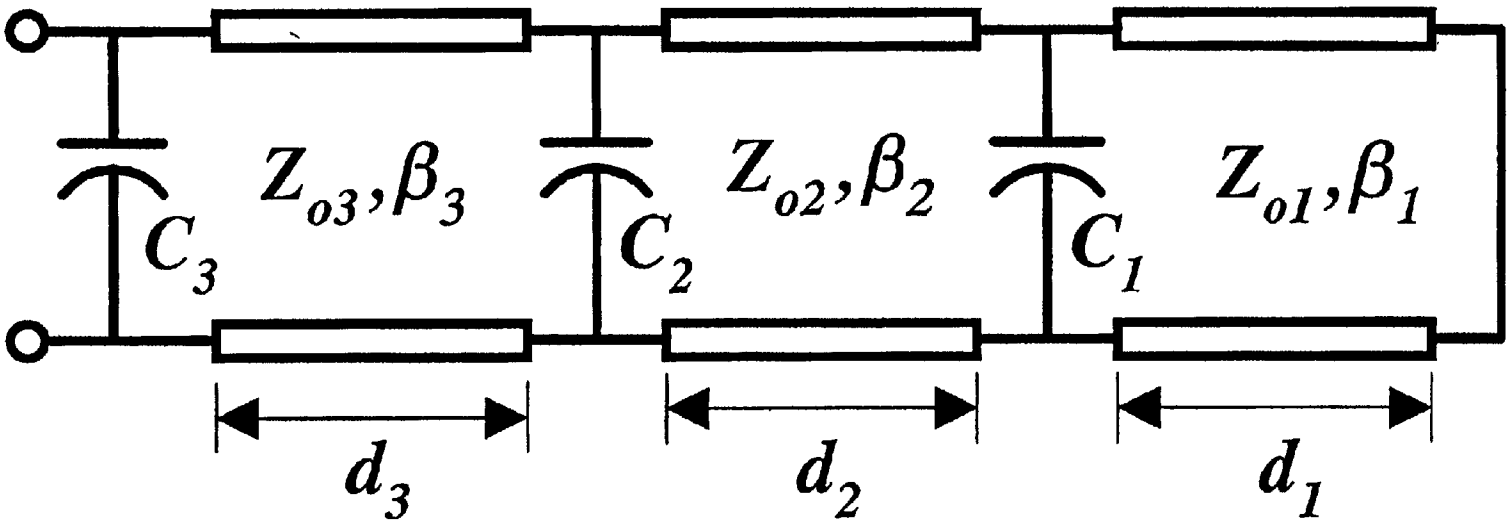
Figure 5A:
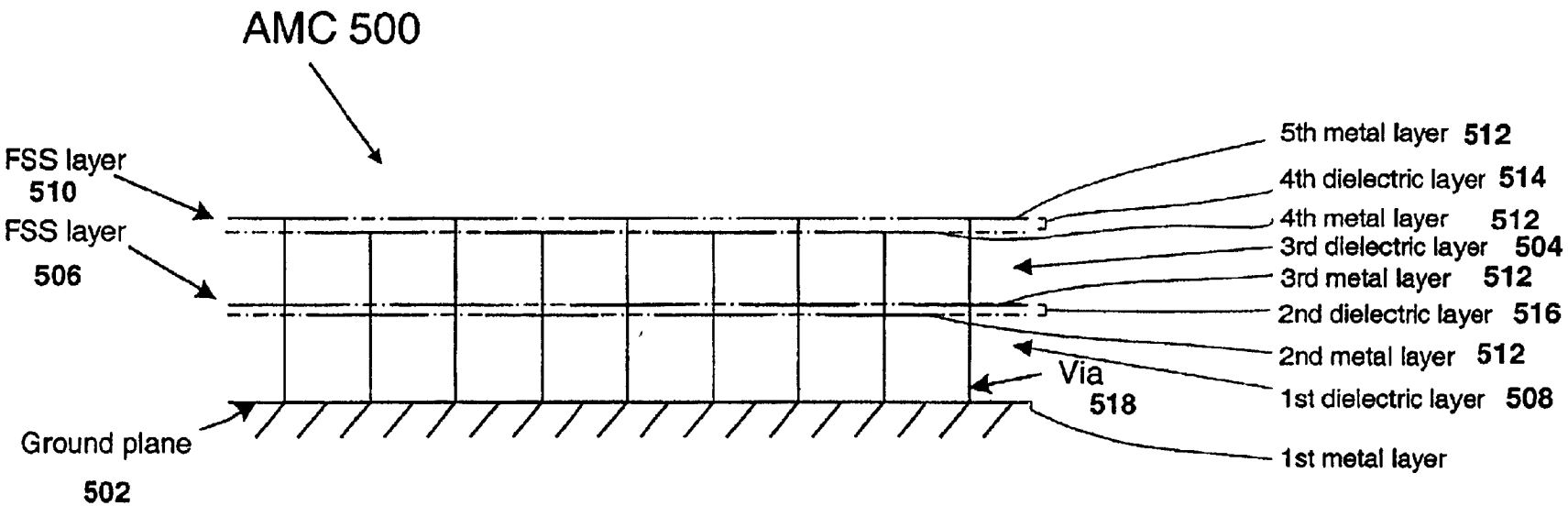
FIGS. 5(*a*)–(*g*) illustrate sectional views of embodiments of a dual band AMC.
Figure 5B:
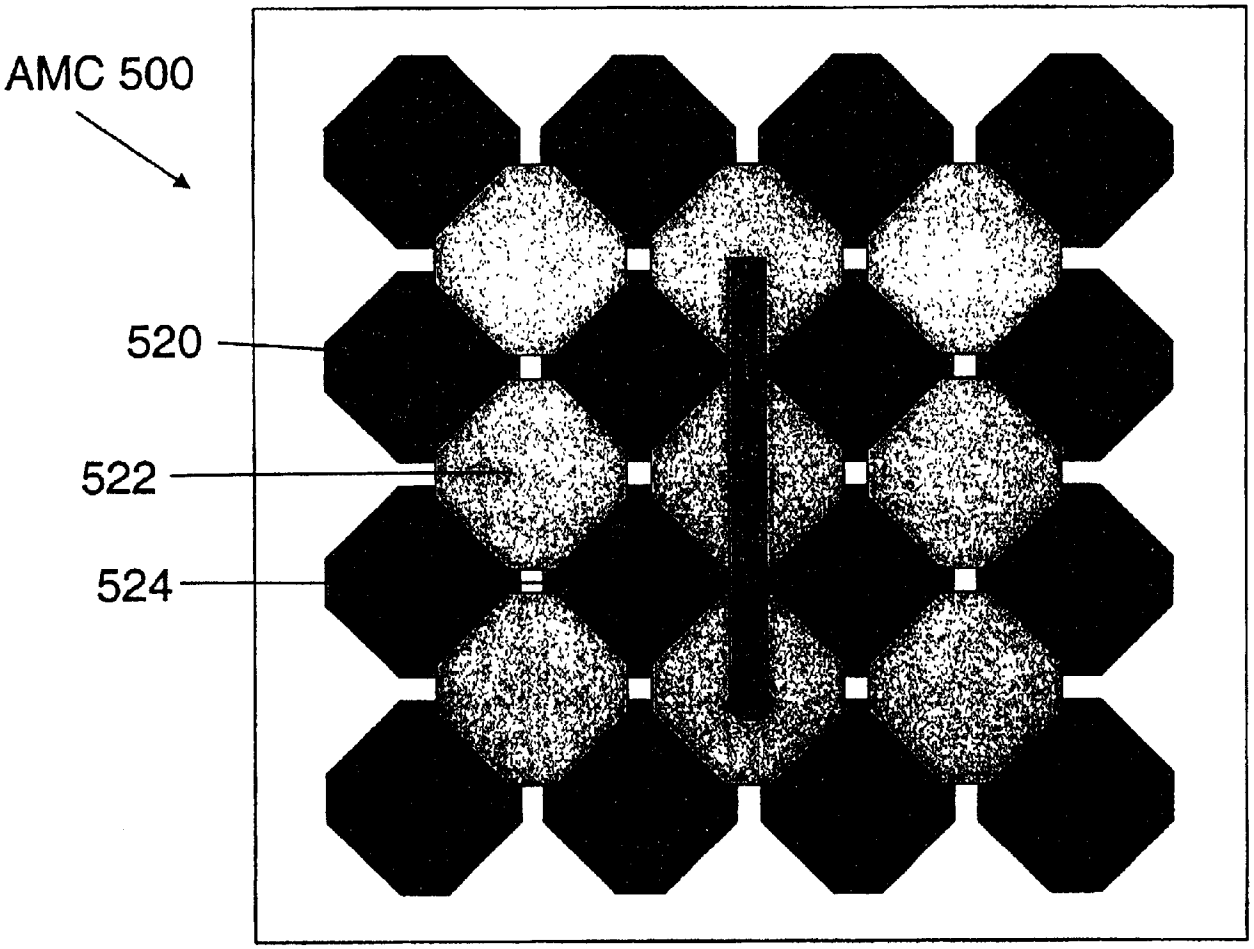
Figure 5C:
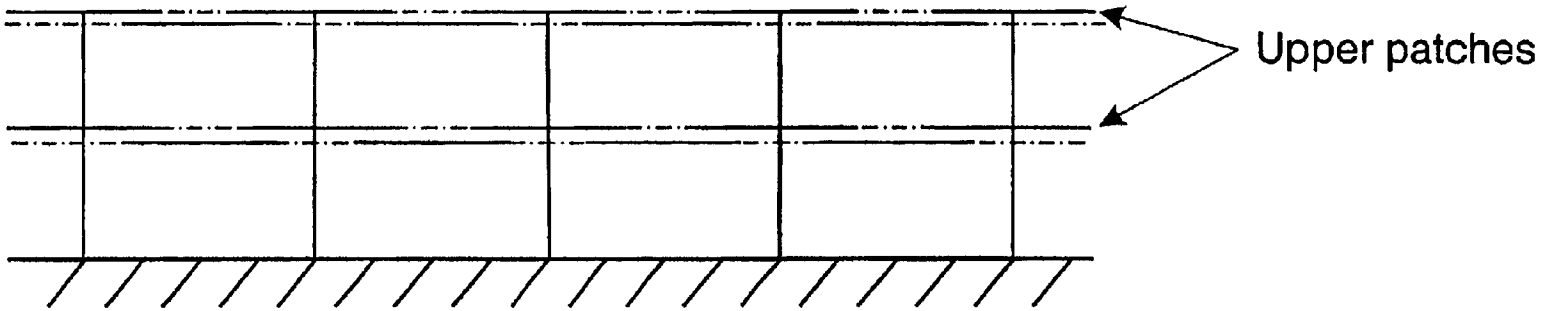
Figure 5D:
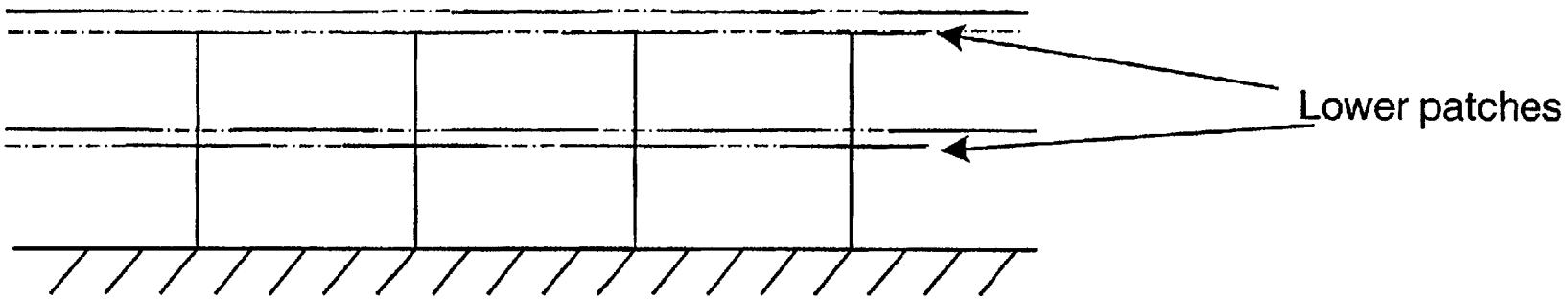
Figure 5E:
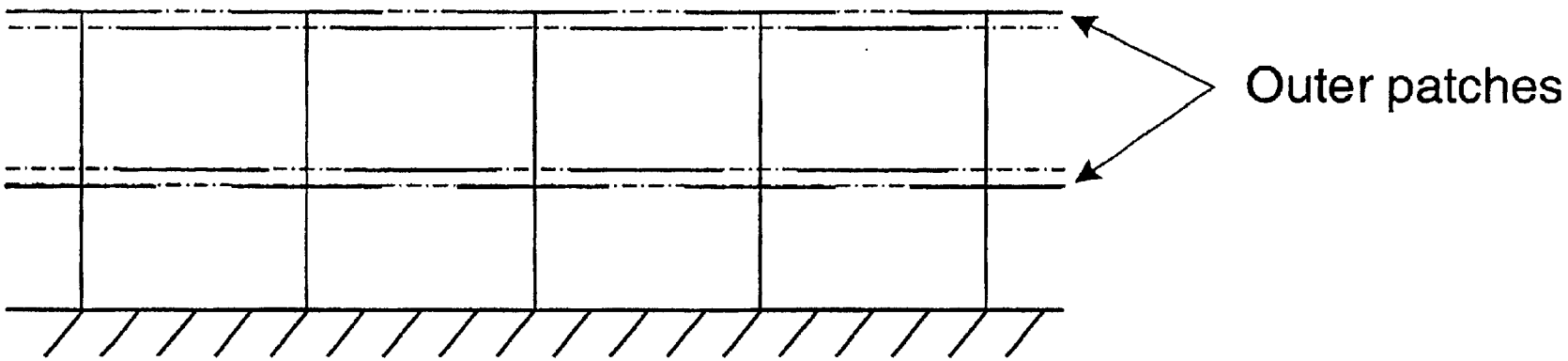
Figure 5F:
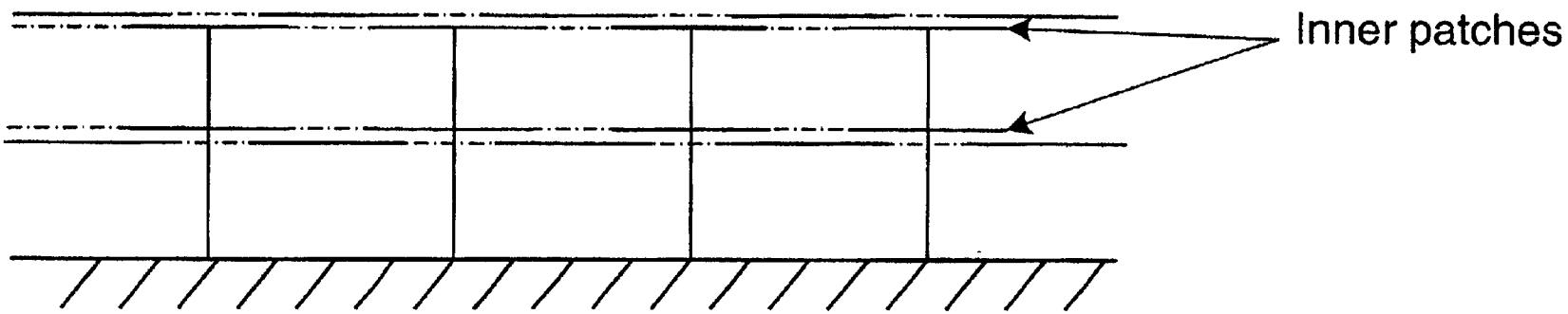
Figure 5G:
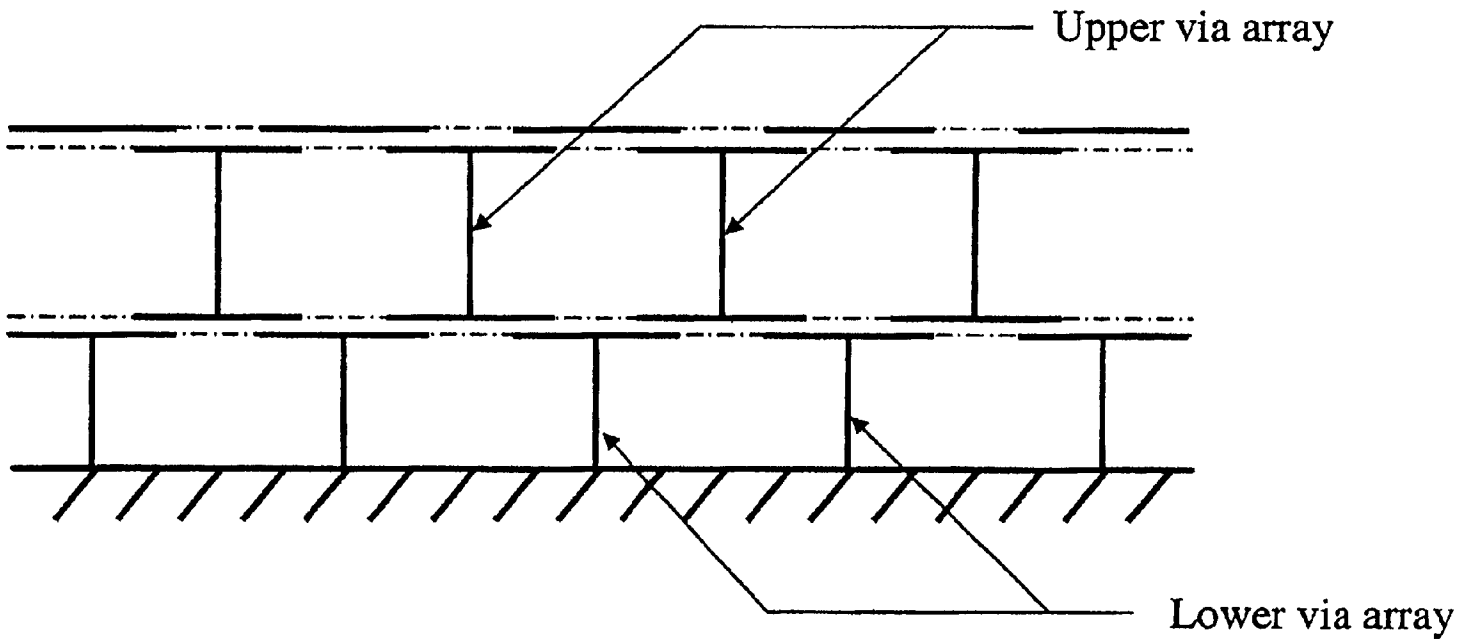
Figure 6A:
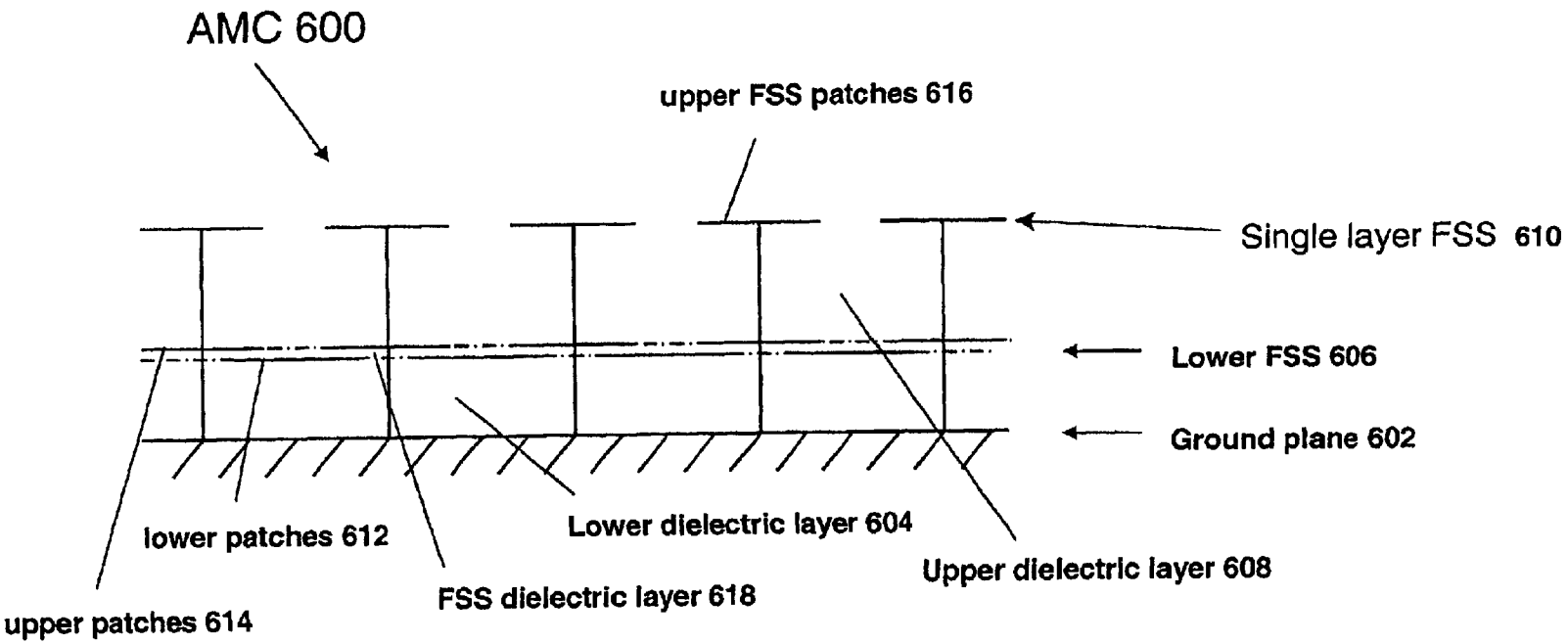
FIGS. 6(*a*)–(*c*) and (*d*) illustrate sectional views and a top view of embodiments of another dual band AMC.
Figure 6B:
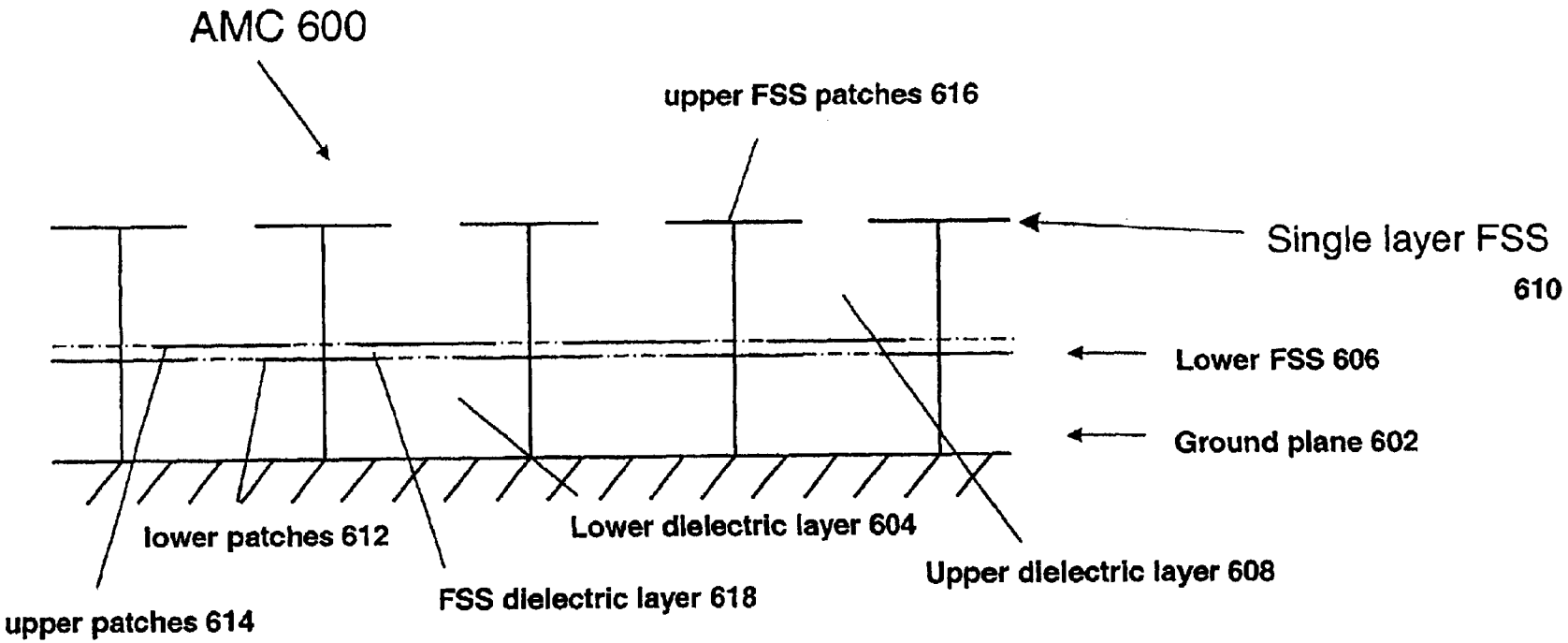
Figure 6C:
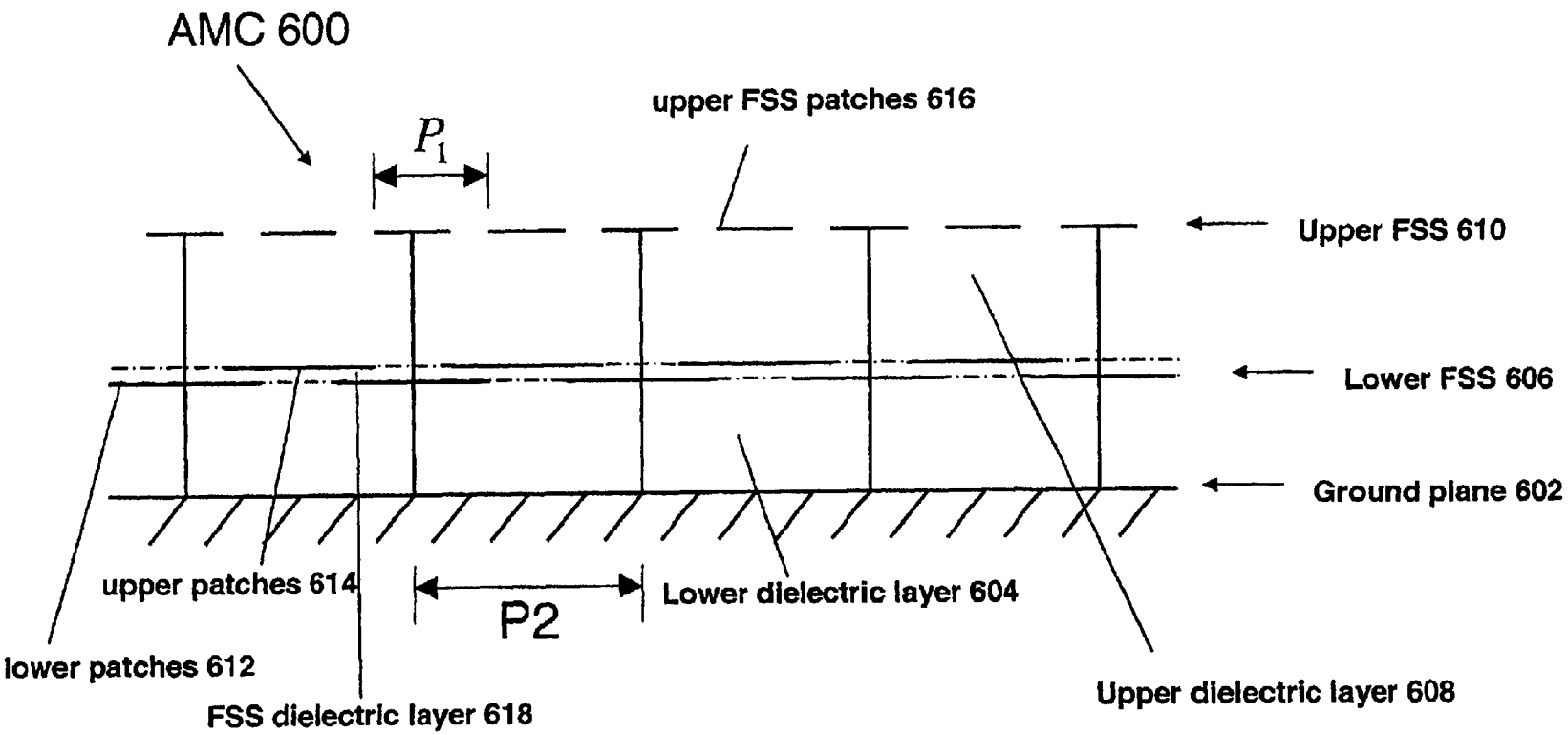
Figure 6D:
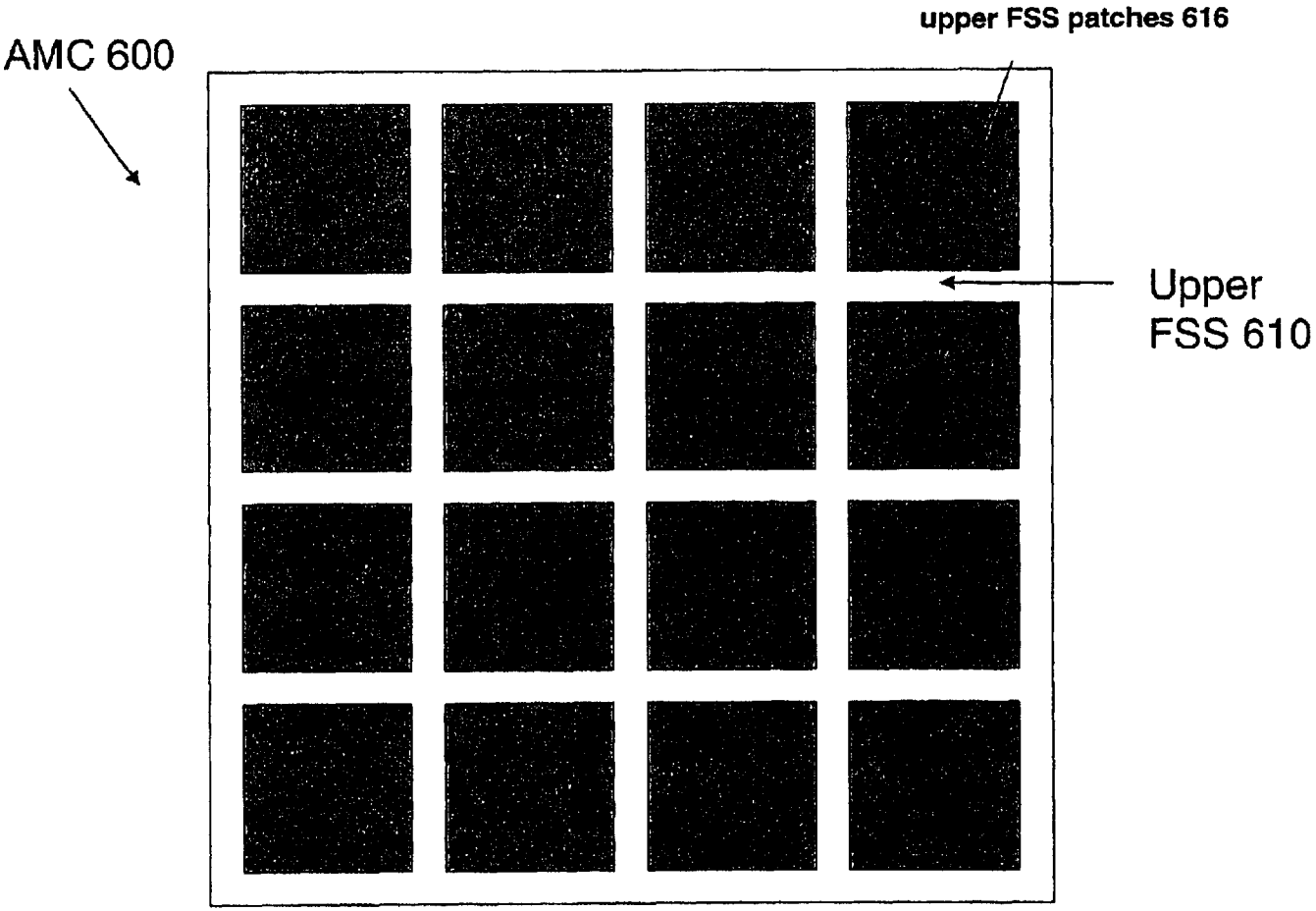

Similarly, another equivalent circuit model 300, shown in FIG. 4, can be used to represent the structure of the dual band AMC. In this model, electrically short transmission lines 306, which act as the inductive elements, replace the inductors 206. An approximate relationship between the value of the inductors 206 and the transmission lines 306 is $L_n=\mu_o d_n$ where $d_n$ is the physical length of a transmission line, and the height of the corresponding dielectric spacer layer. The parameter $\mu_o$ is the permeability of free space. The lengths of the transmission lines, along with the capacitances 304, define the resonant frequencies and input impedance (seen from the input port 302). In both of the above models, a circuit simulator was used to optimize the different parameters for the circuit to have high-impedance performance in the desired frequency bands. Note when modeling the circuit to determine the capacitances and inductances after choosing the desired resonance frequencies, the characteristic impedance of free space (377 Ω) is used as the reference impedance at the input port because the electromagnetic signal that is transmitted from or received by the antenna on the AMC is usually launched into or received from free space.

Turning to the physical structure of the dual band AMC, FIG. 5(*a*) illustrates a sectional view of one embodiment of a dual band AMC. The AMC 500 may be fabricated on a multi-layer printed circuit board (PCB). The AMC 500 includes a ground plane 502 and two frequency selective surfaces (FSS) 506, 510. Each FSS is electrically-thin and contains at least one layer of periodic conductive patches 512. Dielectric spacer layers 504, 508 exist between the frequency selective surfaces 506, 510 and between one of the frequency selective surfaces 506 and the ground plane 502. Conductive vias (vertical conductors) 518 connect at least some of the patches on the frequency selective surfaces 506, 510 to the ground plane. A shorter way to state that some or all of the conductive patches of one or more particular layers on an FSS are connected with the ground plane is to merely say that those layers of conductive patches are connected with the ground plane. Similarly, stating specifically that some of one or more particular layers connected with the ground plane is a shorter way of stating that only some but not all of the conductive patches of those layers of conductive patches are connected with the ground plane.

As illustrated in FIG. 5(*a*), each FSS 506, 510 is itself a multi-layer structure of a thin dielectric layer 514, 516 and conductive patches 512 on opposing surfaces of the thin dielectric layer 514, 516. The conductive patches 512 on each surface are periodic and may be close enough to be capacitively coupled with each other. The conductive patches 512 are formed from any conductive material, typically a metal such as copper or aluminum. In the embodiment shown, the patches 512 on each surface of the FSS 506, 510 have the same periodicity. However, this is not necessary; in alternate embodiments the periodicity of the patches on one FSS may be the same but different from the periodicity of patches on the other FSS or the periodicity of the patches on each surface may be different, dependent on the desired effective sheet capacitance.

The thin dielectric layers 514, 516 between surfaces containing the conductive patches 512 may be a solid dielectric formed from any conventional insulating material, for example, FR4 ($\epsilon_r$~4.5), polyimide ($\epsilon_r$~3.5) or any other conventional printed circuit board material. The dielectric spacer layers 504, 508 between the frequency selective surfaces 506, 510 and between one of the frequency selective surfaces 506 and the ground plane 502 may be formed from material having either the same or different permittivity as the thin dielectric layers 514, 516 between surfaces containing the conductive patches 512. Alternately, low dielectric materials such as foam or air may be used as the dielectric spacer layers 504, 508.

The periodic structure of conductive patches 512 that forms one surface of each of the frequency selective surfaces 506, 510 are planar and both parallel with and electrically close to the ground plane 502 which may be formed from a simple metal plane. The conductive patches 512 may be connected with the ground plane 502 through vias 518.

Figure 11:
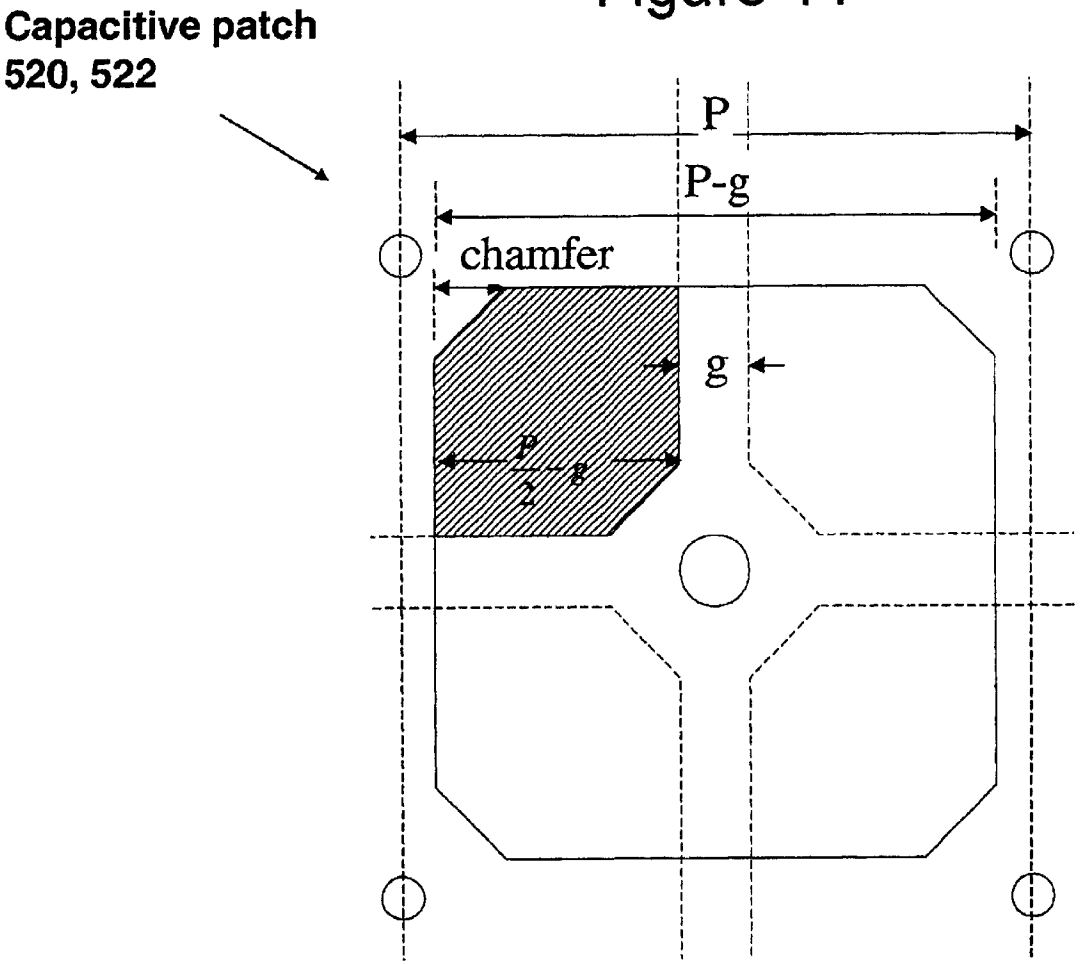
FIG. 11 is a detailed top view of one embodiment of a capacitive patch.

FIGS. 5(*b*) and 12 illustrate a top view of the dual band AMC. As shown, in each frequency selective surface 506, 510, the layers of conductive patches 520, 522 overlap. By this we mean that the patches of the upper layer 522 overlap the patches of the lower layer 520, thereby creating a significant parallel plate capacitance in addition to the edge-to-edge capacitance formed between the patches on each layer. The patches of the upper layer 522 may be formed from either the same conductive material as that of the conductive patches of the lower layer 520 or from different conductive material thereof. A planar antenna 524 is disposed just above the upper layer of conductive patches 520. Assuming a square lattice, the effective sheet capacitance (capacitance) of the frequency selective surface 506, 510 is given by:

$$C = \varepsilon \frac{A}{t}$$

where A is the area of overlap of a single patch on the upper surface of the particular FSS with a single patch on the lower surface of the particular FSS (see FIG. 11), $\epsilon$ is the permittivity, and t is the thickness of the dielectric layer between the upper and lower surfaces. These capacitances represent $C_1$ and $C_2$ in the equivalent circuit models of FIGS. 2(*b*) and 4(*a*), while the dielectric layer between the first FSS and the ground plane and the dielectric layer between the first and second FSS layers correspond to the series inductors or transmission lines.

The patches 520, 522 may be formed from different shapes to effect the desired overlap (and edge-to-edge) capacitance. Typically, the desired capacitance of the lower FSS will be greater than that of the upper FSS and thus the overlap of patches on the lower FSS will be larger than that of the patches on the upper FSS. Note that for the AMC resonant frequencies to be at least an octave apart, the desired capacitances may have significantly different values with ratios of $C_1$ to $C_2$ exceeding 3:1 (to get widely separated the roots of the denominator of the impedance equation). The patches may be any shape, but are usually symmetric about orthogonal in-plane axes of the frequency selective surface. Typically patches are square or, as illustrated in FIGS. 5(*b*) and 11, octagonal/diamond-shaped. If the patches are octagonal, the distance between the edge of the patch at the point in which it starts to deviate from a square and the edge of a square patch of the same maximum dimensions is called the chamfer distance. In this case, the overlap area may be calculated by:

$$A = \left(\frac{P}{2} - g\right)^2 - d^2$$

where P is the periodicity of the patches, g is the minimum width of the gap between adjacent patches within the same plane, and d is the chamfer distance. This area may be substituted into the equation for capacitance, yielding:

$$C = \varepsilon \frac{\left(\left(\frac{P}{2} - g\right)^2 - d^2\right)}{t}$$

Thus, to realize a particular capacitance for each FSS, a number of variables may be selected for optimization: the permittivity and thickness of the thin dielectric layers 514, 516, the periodicity of the patches, the minimum width of the gap between adjacent patches and the chamfer of the patches. For example, one can start by selecting the thickness and permittivity for the thin dielectric layers of both frequency selective surfaces, the gap width between the patches on all surfaces of the frequency selective surfaces, and the chamfer distance (shape) for the patches on the lower of the frequency selective surfaces. Setting the periodicity of the patches on each surface to be the same, the remaining degree of freedom of the upper frequency selective surface for a desired capacitance $C_2$ is the chamfer distance of the upper FSS patches. Alternately, it is possible to set the shape (chamfer distance) of the patches to be constant for all of the layers of the frequency selective surfaces and then allow the gap distance between the patches on the upper frequency selective surface to be different than the gap distance between patches of the lower FSS.

As FIGS. 5(*a*) and 5(*b*) illustrate, the vias 518 may connect the conductive patches 512 with the ground plane 502 at the center of the various patches 512. The vias 518 may be fabricated in the dielectric spacer layers 504, 508 by methods such as plating, deposition or sputtering, or may be a rodded media that is formed by stamping. Not all of the conductive patches 512 need be connected to the ground plane 502 and the vias 518 may connect the patches 512 in different fashions. One advantage of reducing the number of vias is the decreased weight and manufacturing cost. An additional advantage in reducing the number of vias is that the bandgap of the AMC (the difference between the TM mode cutoff and the onset of the TE mode) is broadened as the apparent TM mode cutoff is lowered. This means that the operational bandwidth of the AMC is increased.

Sectional views of the different embodiments of this are shown in FIGS. 5(*c*)–5(*g*). In the embodiment shown in FIG. 5(*c*), for example, all of the upper patches of both frequency selective surfaces are connected with the ground plane (and consequently each other), however, none of the lower patches of each FSS are connected with the ground plane. Similarly, in the embodiment shown in FIG. 5(*d*), all of the lower patches of both frequency selective surfaces are connected with the ground plane while none of the upper patches are connected with the ground plane. In the embodiment shown in FIG. 5(*e*), the patches most distal to each other in the thickness direction (the outer patches) are connected with the ground plane while none of the patches most proximate to each other (the inner patches) are connected with the ground plane. Similarly, in the embodiment shown in FIG. 5(*f*), the patches most proximate to each other in the thickness direction are connected with the ground plane while none of the patches most distal to each other are connected with the ground plane. As shown, when a via is present, it may extend from the ground plane to the patches on the upper FSS. Having vias that extend only from the ground plane to the patches on the lower FSS may be viable, but may also complicate modeling of the circuit by having a non-homogenous rodded media (i.e. the vias having multiple periods).

However, an alternative embodiment is illustrated in FIG. 5(*g*), whereby vias located below the lower FSS are discontinuous with vias located above the lower FSS. As an example, FIG. 5(*g*) shows an upper via array and a lower via array with the same period, but each array is offset with respect to the other by one half of a period in both in-plane (transverse) orthogonal directions (although only one can be seen in the figure). In this case all vias are blind vias, as they do not pass completely through the AMC structure. This arrangement of vias may be preferred if the AMC is fabricated from core layers that contain only the vias and connecting patches, which are then laminated together with thin dielectric spacers to form the FSS dielectric layers.

Figure 7:
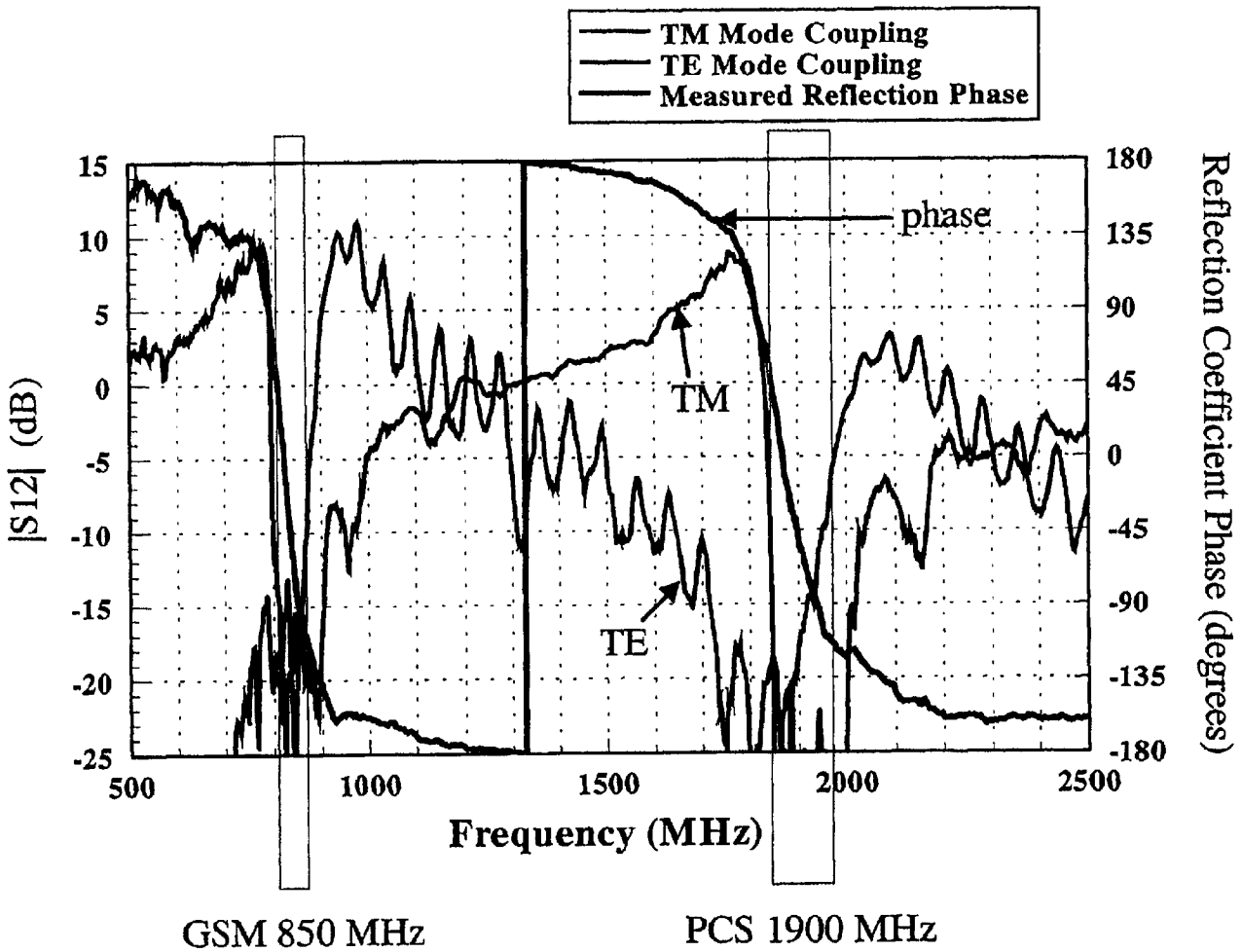
FIG. 7 is a measurement of the phase of the reflection coefficient as well as the TE and TM mode coupling for an embodiment of the dual band AMC.

FIG. 7 is a measurement of the phase of the reflection coefficient as well as the TE and TM mode coupling for a preferred embodiment of the dual band AMC. As seen, the measured AMC exhibits two bands of high surface impedance that correspond to bands in which the TE and TM mode coupling are suppressed. As seen, the reflection phase of zero degrees occurs at about 825 MHz and 1875 MHz, within the GSM and PCS bands respectively. The surface wave bandgap is shown by the rectangular boxes that delineate the region between the TM mode cutoff and the TE mode cutoff. Values of the parameters, used in modeling the dual band AMC prior to physical construction of the AMC, include the permittivity of the dielectric spacer layers 504 and 508 located between the FSS layers and between the lower FSS layer and the ground plane ($\epsilon_r$=4.5). Also included is the permittivity of the thin dielectric layers in the FSS layers (=3.3). For the upper FSS: C=1.8 pF/sq, P=294 mil, chamfer=112 mil, t=2 mil, g=15 mil and for the lower FSS: C=6 pF/sq, P=294 mil, chamfer=35 mil, t=2 mil, g=15 mil. The thickness of the dielectric spacer layers between the lower FSS layer and the ground plane was 124 mil and between the FSS layers was 155 mil.

Sectional views of alternate embodiments are shown in FIGS. 6(*a*)–(*c*). One difference between these embodiments and the embodiments shown in FIGS. 5(*a*)–(*f*) is that the structure of the upper frequency selective surface is different. Specifically, similar to the previous embodiments, the AMC 600 contains a ground plane 602, a lower FSS 606, an upper FSS 610, a lower dielectric spacer layer 604 between the ground plane 602 and the lower FSS 606 and an upper dielectric spacer layer 608 between the lower FSS 606 and the upper FSS 610. The lower FSS 606 is a double layer FSS having a thin dielectric layer 618 with lower patches 612 on the lower surface thereof and upper patches 614 on the upper surface thereof, as in the previous embodiments. However, unlike the previous embodiments, the upper FSS 610 is a single layer FSS that contains a single layer of patches 616 rather than overlapping patches 612, 614 on the thin dielectric layer 618 of the double layer FSS 606.

Using a single layer of patches typically reduces the capacitance, as the edge-to-edge capacitance formed between patches on one plane is often less than the capacitance formed between overlapping patches formed on different but closely spaced planes. Similar to the previous embodiments, FIG. 6(*a*) illustrates an embodiment in which the patches 616 on the single layer FSS 610 are connected with both the patches on the upper surface 614 of the double layer FSS 606 and the ground plane 602, while FIG. 6(*b*) illustrates an embodiment in which the patches 616 on the single layer FSS 610 are connected with both the patches on the lower surface 612 of the double layer FSS 606 and the ground plane 602.

Furthermore, as depicted in FIG. 6(*c*), the patches 616 on the single layer FSS 610 are not required to have the same periodicity as that of the patches on both surfaces 612, 614 of the double layer FSS 606. Nor do all of the patches 616 on the single layer FSS 610 need be connected with the ground plane 602, as shown in FIG. 6(*c*). Also, although the patches 616 on the single layer FSS 610 that are connected with the ground plane 602 are also shown as connected with the patches on the lower surface 612 of the double layer FSS 606, the patches 616 on the single layer FSS 610 may be instead connected with the patches on the upper surface 614 of the double layer FSS 606.

One example of a typical single layer FSS is shown in FIG. 6(*d*), which is a top view of the AMC 600. In this figure, the patches 616 are squares, which maximizes the edge-to-edge capacitance of the FSS 610. As in the double layer FSS embodiments, the shapes of the patches may be changed, for example by adding a chamfer, to decrease the edge-to-edge capacitance. Further, the edge-to-edge capacitance can be increased or decreased by changing the gap width between the patches.

Figure 8:
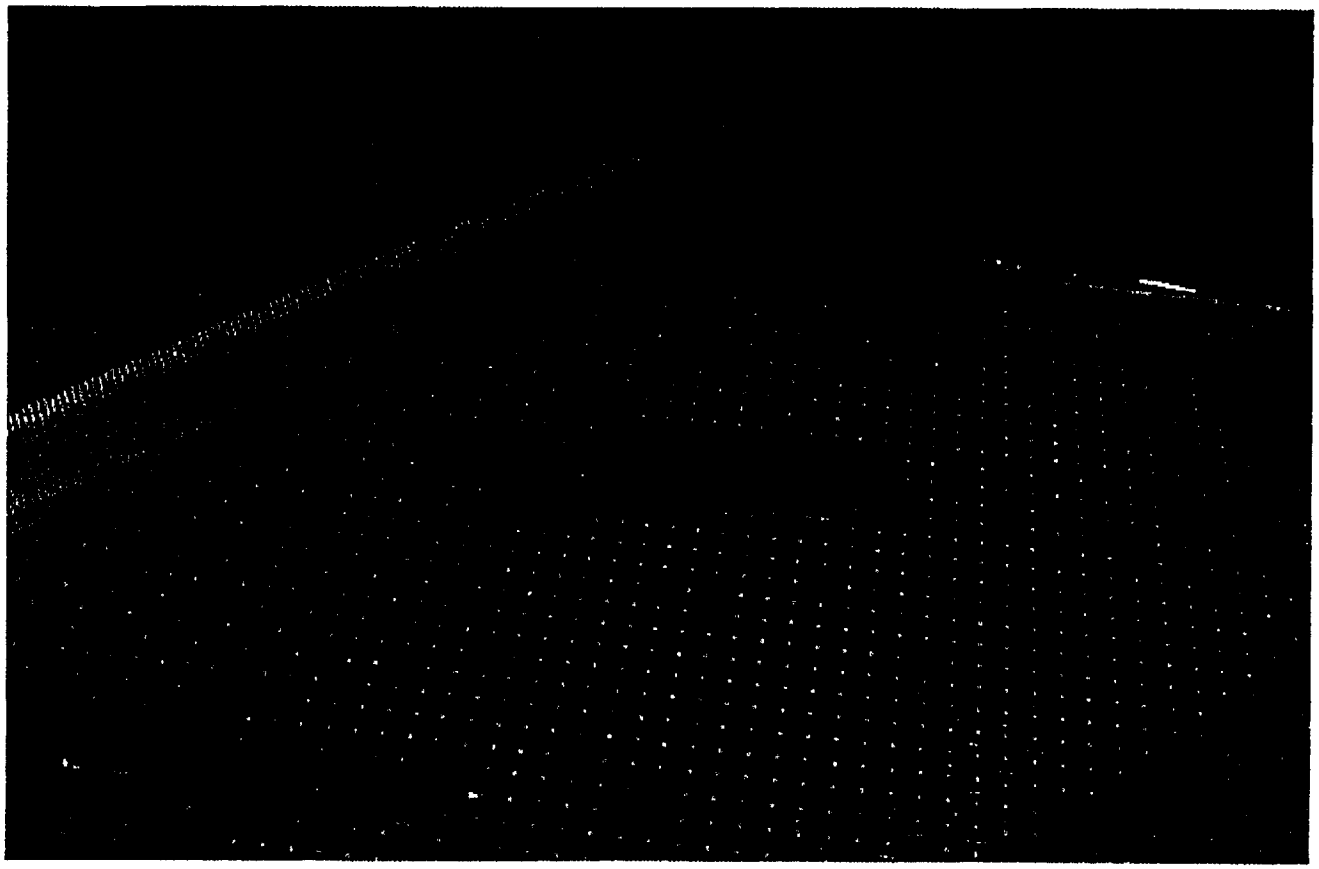
FIG. 8 is a picture of multiple antennas mounted on an embodiment of the dual band AMC.
Figure 9:
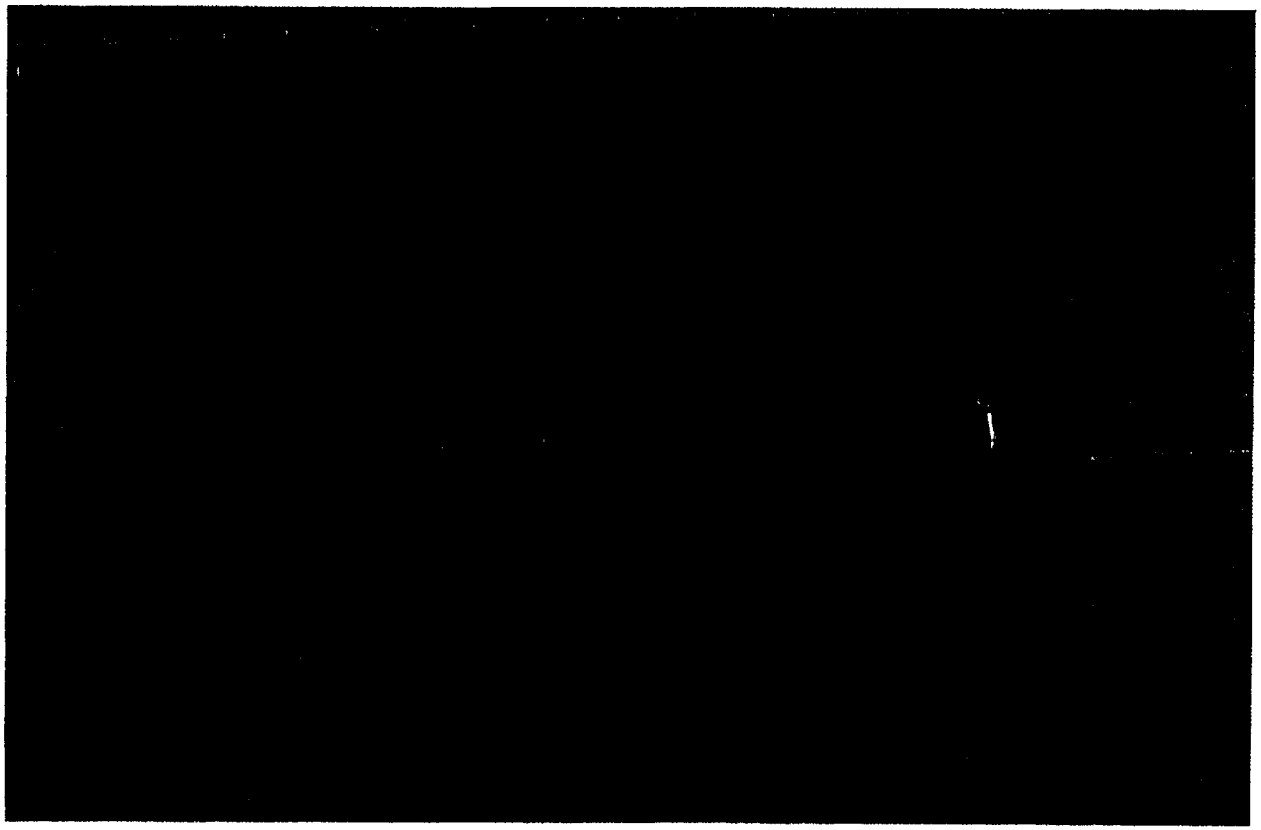
FIG. 9 is a picture of a broadband bowtie antenna.
Figure 10:
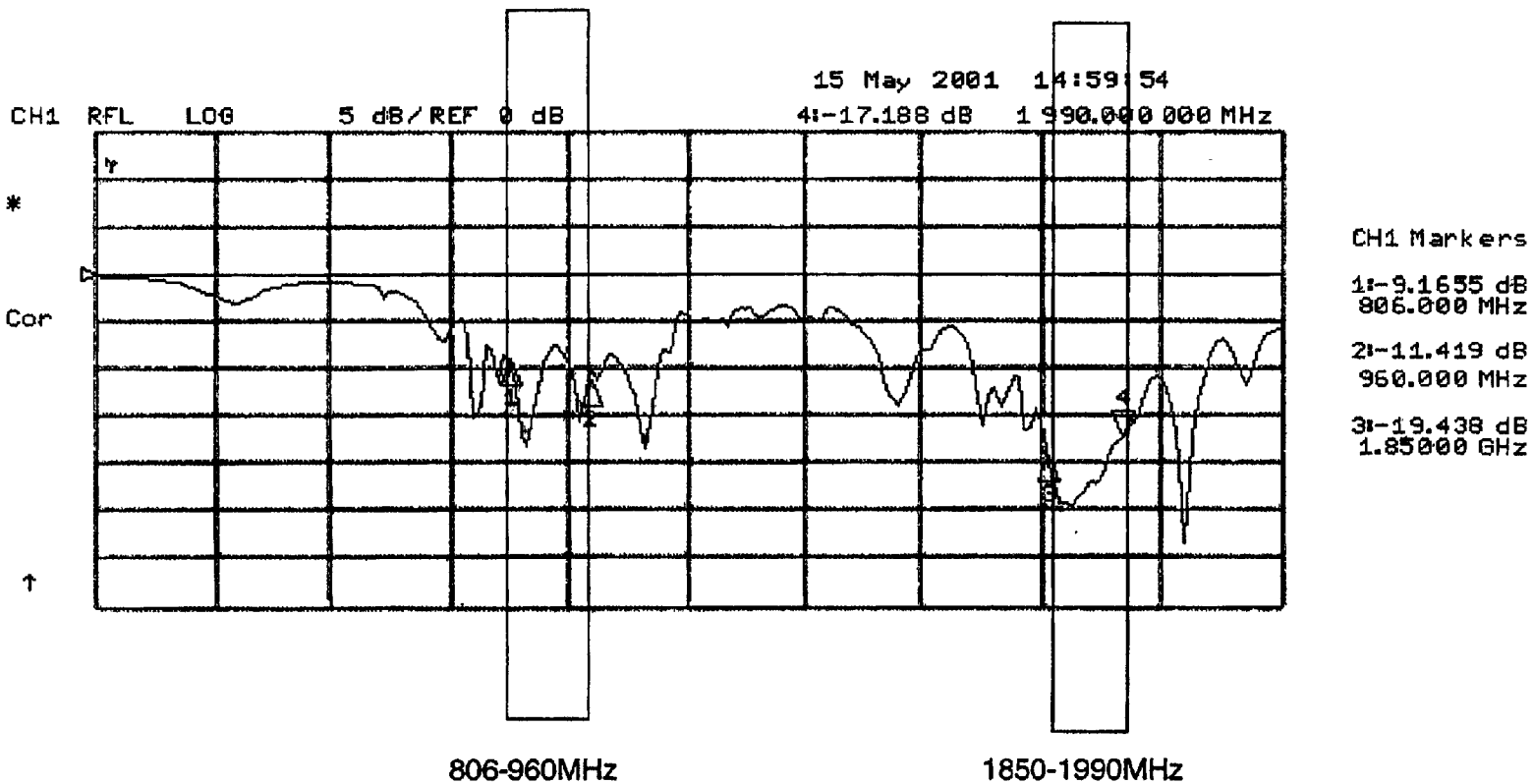
FIG. 10 is a measurement of the return loss of the bowtie antenna on an embodiment of the dual band AMC.

FIGS. 8 and 9 are pictures of various antennas that may be installed on the dual band AMC. FIG. 8 shows multiple antennas of different lengths mounted on the AMC, each of which operates at multiple individual frequencies. FIG. 9 shows a broadband bowtie antenna that operates in free space over a wide range of frequencies, typically starting near 400 MHz. FIG. 10 is a measurement of the return loss of the bowtie antenna on the dual band AMC. As seen, the measured return loss is below −6 dB over the GSM band and below −17 dB over the PCS band. Note that it is also possible to install broadband antennas, such as the strip bowtie of FIG. 9, on a triple or quadruple band AMC. It will be the AMC structure which defines the bandwidth performance of such an antenna system.

Now consider the extension of this work to triple band AMCs. FIG. 2(*c*) is a $3^{rd}$ order Cauer I network, with an input impedance given by $$Z_{in}(s) = \cfrac{1}{sC_3 + \cfrac{1}{sL_3 + \cfrac{1}{sC_2 + \cfrac{1}{sL_2 + \cfrac{1}{sC_1 + \cfrac{1}{sL_1}}}}}}$$

This expression can be rationalized to the following form:

$$Z_{in}(s) = \frac{s^5 L_1 L_2 L_3 C_2 C_3 + s^3(L_1 L_2 C_2 + L_1 L_3 C_2 + L_2 L_3 C_3 + L_1 L_3 C_3) + s(L_1 + L_2 + L_3)}{s^6 L_1 L_2 L_3 C_1 C_2 C_3 + s^4 X + s^2((L_1 + L_2 + L_3)C_1 + (L_2 + L_3)C_2 + L_3 C_3) + 1}$$

where $X = L_1L_2C_1C_2 + L_2L_3C_2C_3 + L_1L_3C_1C_3 + L_1L_3C_1C_2 + L_2L_3C_1C_3$ The AMC reflection coefficient can be calculated from the expression $\Gamma=(Z_{in}-\eta_o)/(Z_{in}+\eta_o)$ where $\eta_o$ is the wave impedance of free space. Again, the frequencies of resonance for the AMC can be determined by finding the roots of the polynomial which comprises the denominator of the rational function for $Z_{in}(s)$.

As an example, a triple band AMC resonant near 850 MHz, 1900 MHz, and 5200 MHz can have the following component values: $L_1$=3 nH, $C_1$=8 pF, $L_2$=4 nH, $C_2$=1.9 pF, $L_3$=2.45 nH, $C_3$=0.5 pF. Its reflection phase response may be seen in FIG. 3(*b*). Given the fact that there are six independent variables, this is but one of many solutions for the given set of three resonant frequencies.

Another equivalent circuit for this same triple band AMC is shown in FIG. 4(*b*). In this model the series inductances have been replaced by electrically short transmission lines where the line length is $d_n=\mu_o^{-1}L_n$, the characteristic impedance is defined by $Z_{on}=\eta_o/\sqrt{\epsilon_m}$, and the phase constant is defined by $\beta_n=(\omega/c)\sqrt{\epsilon_m}$, for n=1, 2, or 3.

One realization of this triple band AMC is shown in FIG. 13. Above the ground plane 1312 lie three capacitive FSS structures 1306, 1307, and 1308, which realize shunt capacitances $C_1$, $C_2$, and $C_3$ respectively. Since $C_1$ and $C_2$ exceed 0.5 pF per square, they are realized with overlapping patches 1306 and 1307, respectively, separated by a thin dielectric layer 1304 and 1305, respectively. As with the dual band AMC described in FIGS. 11 and 12, the size and period of the overlapping patches can be adjusted to achieve the desired capacitance. The third shunt capacitance is smaller than 0.5 pF per square, realized in this embodiment with a single metal layer of Cohn squares 1308. Dielectric spacer layers 1301, 1302 and 1303 are used to separate the FSS layers from each other and from the ground plane 1312 by the desired dimensions $d_n$ where n=1, 2, and 3. In addition, a periodic array of plated through holes, or vias, 1311 comprise vertical conductors that connect the center of the lower patches of each FSS structure to the ground plane 1312.

Although embodiments with only two and three FSS layers are shown, the number of FSS layers may be extended, dependent on the number of desired resonant frequencies and perhaps limited by the weight, thickness and cost requirements of the ultimate device into which the AMC and antenna is placed.

Although not shown, each FSS may be either a simple constant capacitance FSS, as discussed above, or a more complex FSS whose effective transverse permittivity contains Lorentz poles, as described in patent application Ser. No. 09/678,128 entitled "Multi-Resonant High-Impedance Electromagnetic Surfaces" and filed on Oct. 4, 2000 in the names of Rudolfo E. Diaz and William E. McKinzie III, herein incorporated by reference. A non-harmonically linked multi-resonant FSS may include specific inductances and designs to adjust the resonant frequencies. Examples include adding chip inductors to either layer, forming the conductive patches with notches or adding an in-plane grid in either layer or out-of-plane grid on a third layer. These arrangements modify the equivalent circuit by adding new inductances to a particular leg or creating a new parallel leg, thereby adjusting the AMC resonant frequency or frequencies.

Although the present physical embodiments of multi-band AMCs are discussed as being fabricated using conventional printed circuit board materials, an AMC could also be fabricated using metalized plastic components to realize FSS patches and plated through holes.

Antennas that include the antenna element and dual band AMC embodiments above have application to wireless handsets where aperture size and weight need to be minimized, as well as in applications where the absorption of radiated power by the human body is to be minimized. These embodiments also result in easier integration of the antenna into portable devices, such as handheld wireless devices, greater radiation efficiency than other loaded antenna approaches, longer battery life in portable devices, and lower cost than conventional approaches that do not use AMCs. Potential applications include handset antennas for communication systems and portable communication systems such as mobile and cordless phones, wireless personal digital assistant (PDA) antennas, precision GPS antennas, and Bluetooth radio antennas. These dual band AMCs may also be used for base station antennas.

While the invention has been described with reference to specific embodiments, the description is illustrative of the invention and not to be construed as limiting the invention. Various modifications and applications may occur to those skilled in the art without departing from the true spirit and scope of the invention as defined in the appended claims.

We claim:

1. A multi-band artificial magnetic conductor (AMC) comprising an equivalent circuit model, for plane waves at normal incidence, having N shunt capacitors and at least N series inductive elements, arranged in a one port Cauer type I ladder network where N is at least 2, the equivalent circuit having an input impedance with N non-harmonically related resonant frequencies, the capacitors being equivalent sheet capacitances of frequency selective surfaces (FSS) of the AMC.

2. The multi-band AMC of claim 1, wherein the inductive elements of the equivalent circuit model are transmission lines.

3. The multi-band AMC of claim 1, wherein the resonant frequencies fall within GSM 900 MHZ and PCS 1900 MHz bands.

4. The multi-band AMC of claim 1, wherein the resonant frequencies are GPS L1 and L2 frequencies.

5. The multi-band AMC of claim 1, wherein N=2, the reflection phase is approximated by a one port equivalent circuit, and the input impedance of the equivalent circuit is given by $$Z_{in}(s)=\frac{s(L_1+L_2+s^2L_1L_2C_1)}{s^4L_1C_1L_2C_2+s^2(L_1C_1+L_1C_2+L_2C_2)+1}\text{ and } s=j\square.$$

6. The multi-band AMC of claim 5, wherein the resonant frequencies of the equivalent circuit are given by a solution to roots of a denominator of the input impedance.

7. A multi-band antenna system comprising the multi-band AMC of claim 1 and an antenna flush mounted on the AMC.

8. A multi-band antenna system comprising the multi-band AMC of claim 1 and a plurality of antennas flush mounted on the AMC.

9. The multi-band AMC of claim 1, wherein the resonant frequencies are GSM 900 and DCS frequencies.

10. The multi-band AMC of claim 1, wherein the resonant frequencies are in 802.11a and 802.11b frequency bands.

11. A method of establishing design parameters of an artificial magnetic conductor (AMC), resonant in a plurality of non-harmonically related frequency bands, the AMC comprising a plurality of frequency selective surfaces (FSSs), each FSS having a layer of periodic conductive patches, the method comprising:

choosing the non-harmonically related frequency bands;

choosing effective sheet capacitances for each FSS, selecting values for:

gap widths between conductive patches of a first of the FSSs, a chamfer distance for conductive patches of a second of the FSSs, permittivities of dielectric layers between the layers of the conductive patches, between the FSSs, and between one of the FSSs and a ground plane, and thicknesses of the dielectric layers, determining an overlap area of conductive patches on each FSS, determining a periodicity of the conductive patches on each FSS, and determining a chamfer distance for conductive patches of each FSS for which the chamfer distance was not selected.

12. A method of establishing design parameters of an artificial magnetic conductor (AMC) in a plurality of non-harmonically related frequency bands, the AMC comprising a plurality of frequency selective surfaces (FSSs), each FSS having at least one layer of periodic conductive patches, the method comprising:

grounding a first conductive layer;

separating the FSSs;

separating the first conductive layer from one of the FSSs; and connecting the periodic conductive patches on a first layer of the at least one layer of periodic conductive patches of a first FSS of the plurality of FSSs to the first conductive layer and connecting at least some of the periodic conductive patches on a first layer of the at least one layer of periodic conductive patches of a second FSS of the plurality of FSSs to the first conductive layer.

13. A multi-band AMC comprising:

a ground plane;

a first frequency selective surface (FSS) separated from the ground plane by a first dielectric layer, the first FSS having a first and a second layer of periodic conductive patches that overlap and are separated by a second dielectric layer, the first layer of conductive patches more proximate to the ground plane than the second layer of conductive patches;

a second FSS separated from the first FSS by a third dielectric layer, the second FSS having a third layer of periodic conductive patches, the second FSS more distal to the ground plane than the first FSS; and a periodic array of conductors connecting at least one of the layers of periodic conductive patches to the ground plane.

14. The multi-band AMC of claim 13, the second FSS further comprising a fourth layer of periodic conductive patches overlapping the third layer of conductive patches and separated from the third layer of conductive patches by a fourth dielectric layer, the fourth layer of conductive patches more distal to the ground plane than the third layer of conductive patches.

15. The multi-band AMC of claim 13, wherein the third layer of conductive patches and one of the first and second layers of conductive patches are connected with the ground plane.

16. The multi-band AMC of claim 15, wherein the third layer of conductive patches and the one of the first and second layers of conductive patches connected with the ground plane overlap.

17. The multi-band AMC of claim 13, wherein only some of the third layer of conductive patches and only some of one of the first and second layers of conductive patches are connected with the ground plane.

18. The multi-band AMC of claim 14, wherein one of the first and second layers of conductive patches is connected with the ground plane and one of the third and fourth layers of conductive patches are connected with the ground plane.

19. The multi-band AMC of claim 18, wherein the layers of conductive patches connected with the ground plane overlap.

20. The multi-band AMC of claim 13, wherein a plurality of the layers of conductive patches are connected with each other and are unconnected with the ground plane.

21. The multi-band AMC of claim 20, wherein the plurality of the layers of conductive patches have the same periodicity.

22. The multi-band AMC of claim 21, wherein the plurality of the layers of conductive patches are connected with each other through a first array of conductors, the at least one of the layers of periodic conductive patches are connected to the ground plane through a second array of conductors, and the first and second array of conductors are offset from each other by one half of the periodicity of the layers of conductive patches in both in-plane orthogonal directions.

23. The multi-band AMC of claim 13, wherein the periodicity of a plurality of the layers of conductive patches are equal.

24. The multi-band AMC of claim 13, wherein the periodicity of one of the first and second layers of conductive patches is different from the periodicity of the third layer of conductive patches.

25. The multi-band AMC of claim 14, wherein the periodicity of at least one of the first and second layers of conductive patches is different from the periodicity of at least one of the third and fourth layers of conductive patches.

26. The multi-band AMC of claim 13, wherein a capacitance of the first FSS is larger than a capacitance of the second FSS.

27. The multi-band AMC of claim 14, wherein a plurality of the layers of conductive patches are connected with each other and are unconnected with the ground plane.

28. The multi-band AMC of claim 27, wherein plurality of the layers of conductive patches have the same periodicity.

29. The multi-band AMC of claim 28, wherein the plurality of the layers of conductive patches are connected with each other through a first array of conductors, the at least one of the layers of periodic conductive patches are connected to the ground plane through a second array of conductors, and the first and second array of conductors are offset from each other by one half of the periodicity of the layers of conductive patches in both in-plane orthogonal directions.

30. The multi-band AMC of claim 14, wherein the periodicity of a plurality of the layers of conductive patches are equal.

31. The multi-band AMC of claim 14, wherein a capacitance of the first FSS is larger than a capacitance of the second FSS.

32. The multi-band AMC of claim 14, further comprising a fifth layer of periodic conductive patches separated from the fourth layer of conductive patches by a fifth dielectric layer, the fifth layer of conductive patches more distal to the ground plane than the fourth layer of conductive patches.

33. The multi-band AMC of claim 32, wherein a set of layers comprising at least one of the first and second layers of conductive patches, at least one of the third and fourth layers of conductive patches, and the fifth layer of conductive patches are connected with the ground plane.

34. The multi-band AMC of claim 33, wherein a plurality of the layers of conductive patches are connected with each other and are unconnected with the ground plane.

35. The multi-band AMC of claim 34, wherein the plurality of the layers of conductive patches have the same periodicity.

36. The multi-band AMC of claim 35, wherein the plurality of the layers of conductive patches are connected with each other through a first array of conductors, the set of layers are connected to the ground plane through a second array of conductors, and the first and second array of conductors are offset from each other by one half of the periodicity of the layers of conductive patches in both in-plane orthogonal directions.

37. A multi-band antenna system comprising the multi-band AMC of claim 13 and an antenna flush mounted on the AMC.

38. A multi-band antenna system comprising the multi-band AMC of claim 13 and a plurality of antennas flush mounted on the AMC.

39. The multi-band AMC of claim 13, wherein at least some of the third and one of the first and second layers of conductive patches are connected with the ground plane by a rodded medium.

40. The multi-band AMC of claim 14, wherein at least some of one of the first and second and one of the third and fourth layers of conductive patches are connected with the ground plane by rodded media.

41. A multi-band antenna system comprising the multi-band AMC of claim 14 and an antenna flush-mounted on the AMC.

42. A multi-band antenna system comprising the multi-band AMC of claim 14 and a plurality of antennas flush-mounted on the AMC.

43. The multi-band antenna system of claim 37, wherein the antenna is a broadband antenna that provides coverage for both multi-bands as well as frequencies between the multi-bands.

44. The multi-band antenna system of claim 38, wherein the antenna is a multiple-resonance antenna that has individual resonances at frequencies within each of the multi-bands.

45. The multi-band antenna system of claim 38, wherein each antenna is a single-resonance antenna that provides primary coverage for one of the bands.

46. The multi-band AMC of claim 13, wherein vias are connected in a center of at least some of the conductive patches.

47. The multi-band AMC of claim 14, wherein vias are connected in a center of at least some of the conductive patches.

48. The multi-band AMC of claim 13, wherein at least conductive patches on at least one of the first, second and third layers of conductive patches have chamfers.

49. The multi-band AMC of claim 14, wherein at least conductive patches on at least one of the layers of conductive patches have chamfers.

50. An antenna comprising the multi-band AMC of claim 13.

51. A communication system comprising the multi-band AMC of claim 13.

52. A portable communication system comprising the multi-band AMC of claim 13.

53. An antenna comprising the multi-band AMC of claim 14.

54. A communication system comprising the multi-band AMC of claim 14.

55. A portable communication system comprising the multi-band AMC of claim 14.

56. An antenna comprising the multi-band AMC of claim 32.

57. A communication system comprising the multi-band AMC of claim 32.

58. A portable communication system comprising the multi-band AMC of claim 32.

59. A multi-band artificial magnetic conductor (AMC) comprising:

a ground plane;

a plurality of frequency selective surface (FSS) layers, each FSS layers having periodic conductive patches;

a first dielectric layer separating each of the FSS layers;

a second dielectric layer separating the ground plane from one of the FSS layers; and an array of vertical conductors connecting at least some of the conductive patches on at least two of the FSS layers to the ground plane.

60. An antenna comprising the multi-band AMC of claim 59.

61. A communication system comprising the multi-band AMC of claim 59.

62. A portable communication system comprising the multi-band AMC of claim 59.

* * * * *